US007232335B2

(12) United States Patent
Preuhs et al.

(10) Patent No.: US 7,232,335 B2
(45) Date of Patent: Jun. 19, 2007

(54) K-SERIES WATTHOUR METER SOCKET ADAPTER

(75) Inventors: Allen V. Preuhs, Howell, MI (US); Darrell Robinson, Highland, MI (US); Christophor D. Napier, Akron, OH (US); Gregory L. Zook, Toledo, OH (US)

(73) Assignee: Ekstrom Industries, Inc., Farmington Hills, MI (US)

( * ) Notice: Subject to any disclaimer, the term of this patent is extended or adjusted under 35 U.S.C. 154(b) by 0 days.

(21) Appl. No.: 11/129,525

(22) Filed: May 13, 2005

(65) Prior Publication Data

US 2006/0258204 A1 Nov. 16, 2006

(51) Int. Cl.
*H01R 33/945* (2006.01)

(52) U.S. Cl. ..... 439/518; 439/508

(58) Field of Classification Search ..... 439/508, 439/511, 517, 146

See application file for complete search history.

(56) References Cited

U.S. PATENT DOCUMENTS

| | | | | |
|---|---|---|---|---|
| 4,516,817 | A | 5/1985 | Deters | 439/513 |
| 4,547,036 | A | 10/1985 | Keglewitsch et al. | 439/680 |
| 4,553,802 | A | 11/1985 | Ruehl | 439/266 |
| 4,659,158 | A | 4/1987 | Sakamoto et al. | 439/507 |
| 4,883,430 | A | 11/1989 | Siemon et al. | 439/510 |
| 5,033,973 | A * | 7/1991 | Pruehs et al. | 439/167 |
| 5,609,493 | A | 3/1997 | Cheng et al. | 439/157 |
| 5,879,203 | A | 3/1999 | Egle et al. | 439/830 |
| 6,015,314 | A * | 1/2000 | Benfante | 439/517 |
| 6,099,347 | A | 8/2000 | Hoyt et al. | 439/510 |
| 6,402,548 | B1 | 6/2002 | Ruiz et al. | 439/507 |
| 6,592,399 | B2 * | 7/2003 | Robinson et al. | 439/517 |
| 6,663,405 | B1 | 12/2003 | Robinson et al. | |
| 6,663,422 | B1 | 12/2003 | Robinson et al. | |
| 6,752,652 | B1 * | 6/2004 | Robinson | 439/517 |
| 2003/0008551 | A1 | 1/2003 | Chang | 439/512 |

OTHER PUBLICATIONS

Marwell Corporation; Safety Disconnect for the K-7; Marwell News, May 2001.

Marwell Corporation; 320 AMP, K-7 to Socket Conversion; Marwell News, Jan. 2002.

Marwell Corporation; Convert Landis & Gyr K-7 to 2S Meter; Marwell News, May 2003.

Meter Devices Co., Inc.,(a sister company to Ekstorm Instustries, Inc., the assignee of the above-identified application, both of which are part of E.J. Brooks, Co., Livingston, NJ); 13-Terminal Ringless Transocket; Schematic; Feb. 1999.

(Continued)

*Primary Examiner*—Tho D. Ta
(74) *Attorney, Agent, or Firm*—Young Basile Hanlon MacFarlane & Helmholdt P.C.

(57) ABSTRACT

A watthour meter socket adapter carries rigid conductors extending from a connection to jaw contacts in a housing, the conductors mounting the socket adapter between the lower load mounting connections and the upper line mounting connections in a meter fitting to define an in-service metering position where the socket adapter and the watthour meter are disposed in the normal out-of-service, non-metering position in the meter fitting. The socket adapter housing is spaced from a ground terminal insulating block mounted over a ground terminal in the meter fitting. In another aspect, a plurality of current transformers are carried on a plate which mounts in an existing K-series meter fitting line and load terminal connections footprint.

37 Claims, 16 Drawing Sheets

OTHER PUBLICATIONS

A Marwell K-style watthour meter socket adapter for plug-in watthour meters in a K-series socket is shown in Figs. A, B and C.

Copy of Office Action dated Jan. 11, 2006 for U.S. Appl. No. 11/039,545.

* cited by examiner

FIG - 17
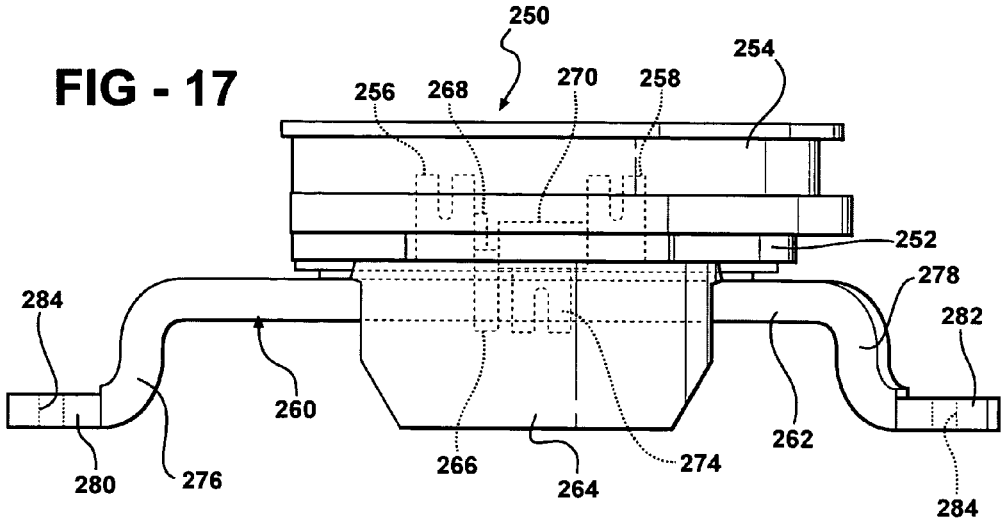
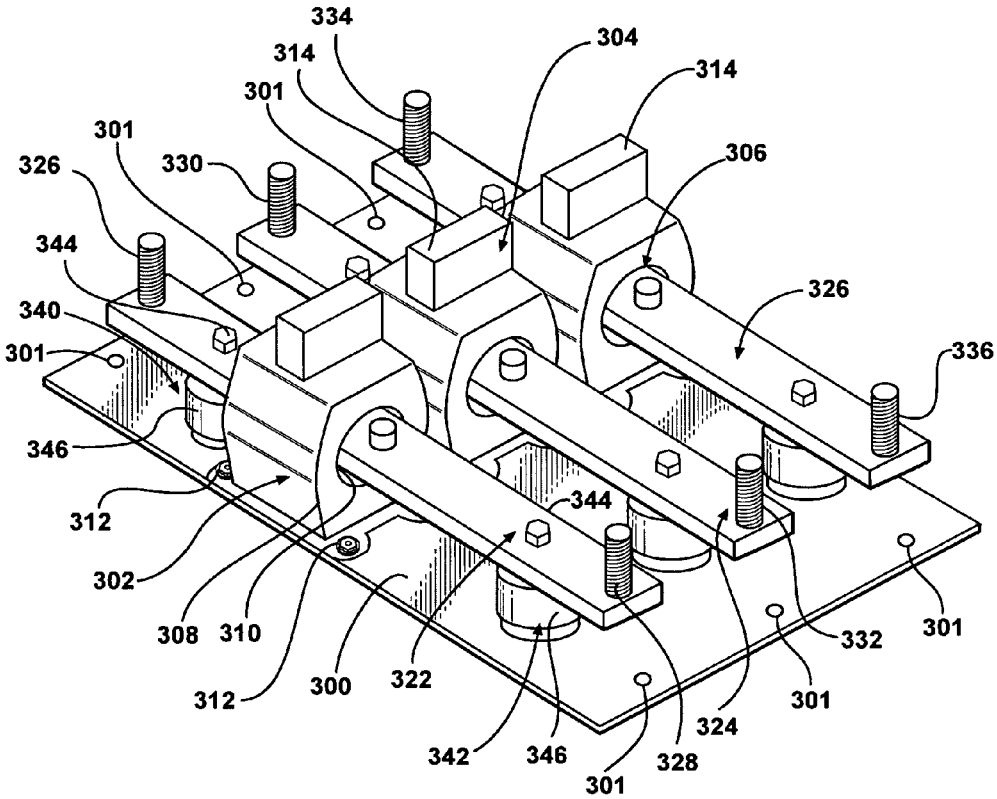
FIG - 18

K-SERIES WATTHOUR METER SOCKET ADAPTER

BACKGROUND

The present invention relates, in general, to electrical power metering apparatus and, specifically, to electrical watthour meter socket adapters and watthour meter sockets.

In the electric utility industry, plug-in, socket-type watthour meters are commonly employed to measure electric power consumption at a residential or commercial building establishment. A socket is mounted on a wall of the residence or building and contains terminals which are connected to electric line and electric load conductors. The terminals are also connected to internal conductors within the socket which extend to jaw contacts positioned to receive the blade terminals of a plug-on watthour meter to complete an electric circuit through the watthour meter between the line and load terminals and the conductors.

One type of meter socket has a ring-type cover which includes an outwardly projecting, annular mounting flange surrounding an opening in the cover through which the blade terminals of a watthour meter extend. The mounting flange is sized to mate with a complementary formed mounting flange on the bottom of the watthour meter.

In high power applications, current levels exceed the ratings of commonly available watthour meters. In these applications, current transformers are placed around the incoming line conductors and connected to watthour meter receiving jaw contacts to enable watthour meters to measure load current and provide a scaled power measurement.

A special socket, referred to as a K-series socket, shown in FIGS. 1–5 has been developed. The socket is designed for single or three-phase power and is designed to carry current up to 400 amps or more. Rigid bus bar terminals are provided in the upper portion of the socket for receiving the line conductors. Similar plate-like bus bar terminals are mounted at the bottom of the socket for receiving the load conductors. A single mounting fastener, such as a threaded stud, is provided on each load bus bar for receiving a rigid load bus bar extending from a watthour meter which is mountable in the socket. Similar mounting fasteners or threaded studs are mounted in a first row on the upper line power bus bars for receiving a separate line bus bar extending from a watthour meter.

As also shown in FIGS. 1–5, shorting bus bars extend between each line bus bar and the corresponding load bus bar provide a power connection from the power distribution line network to the individual load distribution network in a building.

A cover is mountable over the socket and has an aperture formed in a slidable cover portion for allowing an end portion of the watthour meter to extend therethrough for easy viewing of power measurements. The aperture is mounted in a plate slidably captured on the back of the socket cover. The aperture is offset from the center of the plate such that flipping the plate 180° enables the watthour meter when moved from a lowered operative position to a separate upper inoperative position, to extend through the aperture.

In the inoperative position, the line bus bars on the watthour meter are disengaged from the line bus bar fasteners and moved to a separate spaced row of fasteners, also extending from the line bus bars. However, separate electrically insulting posts are provided in a spaced manner from the load bus bar studs for receiving the load bus bars on the watthour meter in the disconnected position. This disconnects the watthour meter from measurement or service and places it in an out-of-service position.

Attempts to use a watthour meter socket adapter for a plug-in watthour meter in a K-series socket have met with limited success. The size and location of the line conductor insulator blocks, the ground terminal connector and the ground terminal insulator block necessitated socket adapter bus bars having a smaller cross-section than required for current applications up to 400 amps. In addition, additional features and refinements added over time such as cutouts in the sidewall of the socket adapter to accommodate the insulator blocks and ground terminal, make use of the socket adapter difficult without first removing the additional features and refinements.

As is evident from FIGS. 1–5, a specially designed watthour meter with rigid bus bars is necessary for mounting in the K-series socket in both the power measurement and non-power measurement positions. The shape, thickness and spacing of the meter bus bars must also take into account a ground terminal and associated insulator block and insulator blocks between the line bus bars. As a result, prior K-series sockets have not been able to successfully receive watthour meter socket adapters designed for receiving standard, plug-in watthour meters.

In electrical power service sites, it frequently becomes necessary to up grade the electrical power service to supply higher current to the customer site. At high current levels, current transformers are employed to provide lower current levels which can be metered by watthour meters. However, such current transformers require special mounting in a socket which increases installation time and results in a higher installation cost.

It is believed that there still is a need for a watthour meter socket adapter which can be successfully employed in a K-series watthour meter socket. It is also desirable to provide a watthour meter socket adapter for mounting a plug-in watthour meter in a K-series meter socket which can be economically constructed with minimal modification to existing watthour meter socket adapter designs. It would also be desirable to provide a current transformer mounting apparatus which fits within an existing K-series meter socket footprint for reduced installation time and costs when it becomes necessary to increase power to a customer site.

SUMMARY

A watthour meter socket adapter mounts a plug-in watthour meter in a K-series meter socket.

In one aspect, an electrical power service apparatus includes a meter fitting having an enclosure with line and load electrical power conductor connection terminals and line and load electrical connections for connecting a watthour meter in one of an in-service metering position and an out-of-service, non-metering position with respect to the line and load power conductor connection terminals. Socket adapter means, receiving a plug-in watthour meter, mounts the watthour meter in the normally out-of-service position with respect to the line and load power conductor connection terminals while electrically connecting the watthour meter to the line and load electrical connections in an in-service metering connection.

In another aspect, an electric power service apparatus includes line and load terminals mounted in a socket and receiving electric power line and load conductors. A line bus bar is connected to each line terminal. Upper normally out of service line connections and lower normally in-service line connections are mounted on each line bus bar. A load bus bar is connected to each load terminal. A lower load connection is connected to the load bus bar.

A socket adapter carries jaw contacts for removably receiving blade terminals of a watthour meter. Electric conductors are carried on the socket adapter and extend therefrom to connection ends. The conductors have an overall length to connect the socket adapter conductors to the lower bus bar connections and either of the upper or lower line connections on the line bus bars, to define an in-service metering position of the socket adapter relative to the meter socket even though the socket adapter may be disposed in the normally out-of-service position relative to the meter socket. This enables the socket adapter to receive a watthour meter in a metering position while spacing the socket adapter from a ground terminal insulating block mounted adjacent to a ground terminal in the enclosure.

In the in-service metering position of the socket adapter, the socket adapter is positioned relative to an aperture in the enclosure cover to enable a watthour meter mounted in the socket adapter to extend through the aperture in the cover in the normally out-of-service metering position.

Each of the socket adapter conductors has a first end portion disposed in the socket adapter defining a first plane, a second end portion defining a second plane spaced from the first plane, and an intermediate portion coupling the first and second end portions.

In another aspect, a jumper terminal is mounted on the socket adapter. An electrical conductor extends interiorly of the socket adapter between the terminal and a socket adapter ground terminal. The jumper terminal is connectable in the socket ground terminal when the socket adapter is connected to the line and load connections in the meter socket.

In another aspect, an electrical power service apparatus includes a housing having a mounting surface. Terminal ends of electric power line conductor and electric power load conductors are disposed in the housing in a first service connection position. A mounting plate is mountable on the mounting surface. A plurality of current transformers are mounted on the mounting plate. A busbar extends through each current transformer and has first and second ends spaced from each current transformer. Mounting means are carried on the first and second ends of each bus bar for receiving a terminal end of one of the electric power line and one of the electric power load conductors. The mounting means are disposed in the first service connection position in the housing.

A potential terminal may be mounted on each busbar. Means are also provided for fixing each busbar on the mounting plate. The fixing means includes an electrically insulated standoff disposed between each busbar in the mounting plate.

The disclosed watthour meter socket adapter enables a plug-in watthour meter to be employed in a K-series meter fitting without modification to the socket adapter structure. The socket adapter and the conductors are constructed to define an in-service metering position of the socket adapter relative to the enclosure even though the socket adapter and attached watthour meter are disposed in the normal out-of-service metering position in the enclosure. This enables the socket adapter to uniquely clear the ground terminal insulating block mounted adjacent the ground terminal in the meter fitting without requiring modification, such as cut outs, to the structure of the socket adapter housing which would diminish its integrity.

The socket adapter and the socket adapter conductors are positioned such that the socket adapter clears the ground terminal insulating block mounted adjacent the enclosure ground terminal. The socket adapter is mountable to the existing line and load connections in the K-series meter fitting without substantial modification to the integrity or the structure of the socket adapter housing.

The mounting of current transformers on a mounting plate uniquely enables the current transformers to be installed in the same footprint as metering components in an existing K-series meter fitting for reduced installation time and costs when it becomes necessary to increase current levels supplied to a customer site.

BRIEF DESCRIPTION OF THE DRAWING

The various features, advantages and other uses of the present invention will become more apparent by referring to the following detailed description and drawing in which:

FIG. 17 is a side elevational view of another aspect of a watthour meter socket adapter;

FIG. 18 is perspective view of another aspect of an electrical power service apparatus;

DETAILED DESCRIPTION

Figure 1:
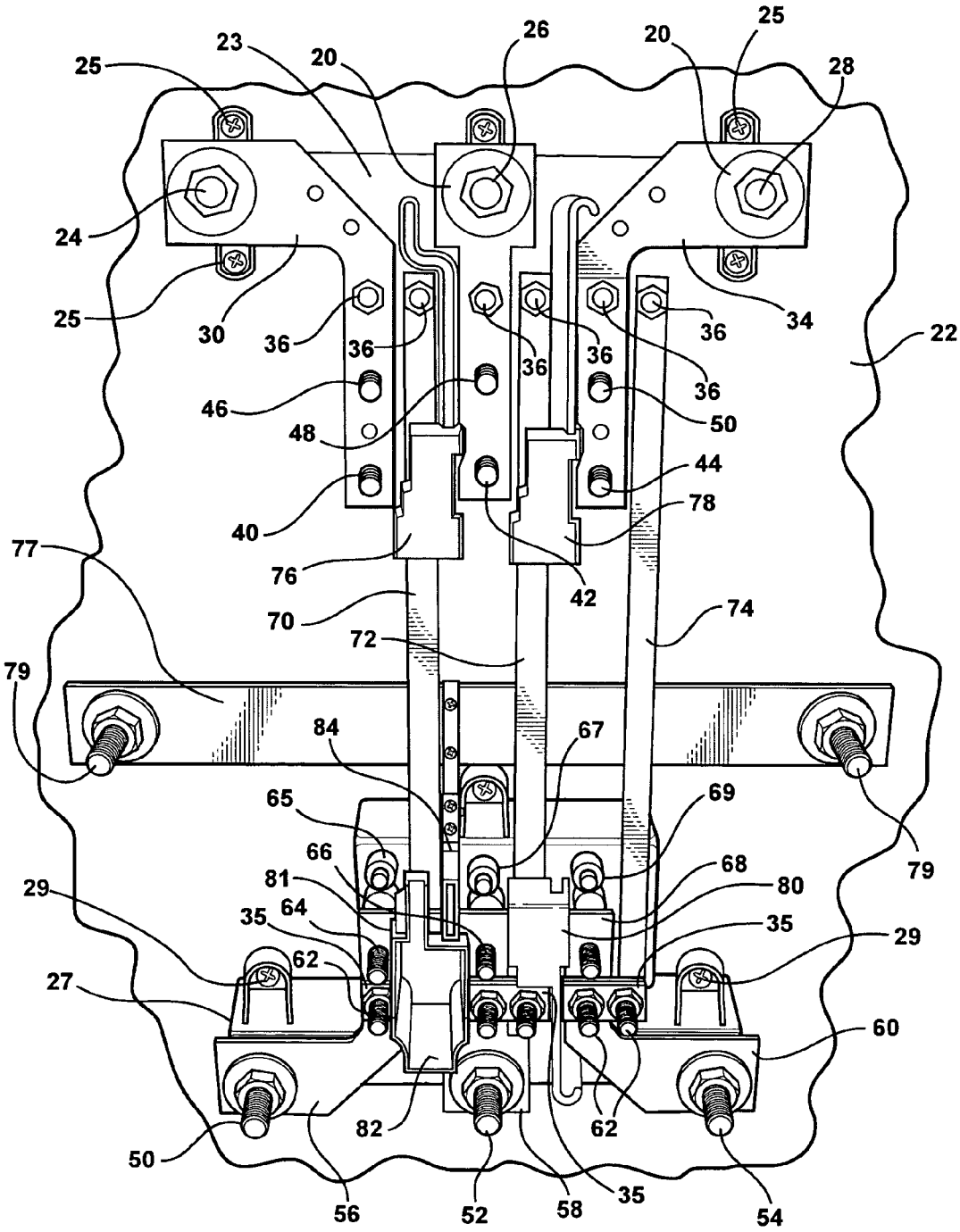
FIG - 1 PRIOR ART
FIG. 1 is a perspective view of a prior art K-series meter socket without a watthour meter.
Figure 2:
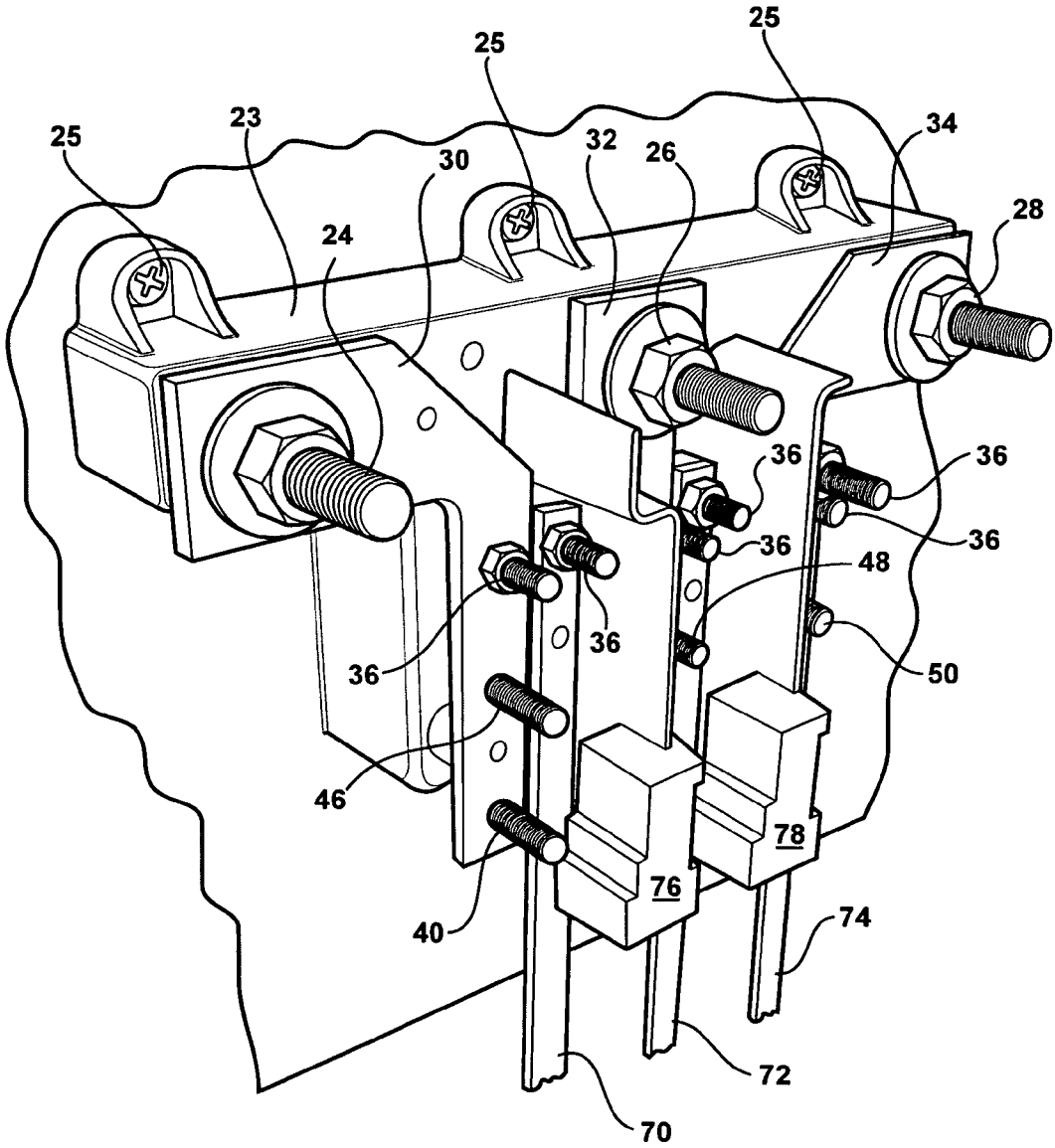
FIG - 2 PRIOR ART
FIG. 2 is an enlarged, perspective view of the line terminals in the prior art socket shown in FIG. 1.
Figure 3:
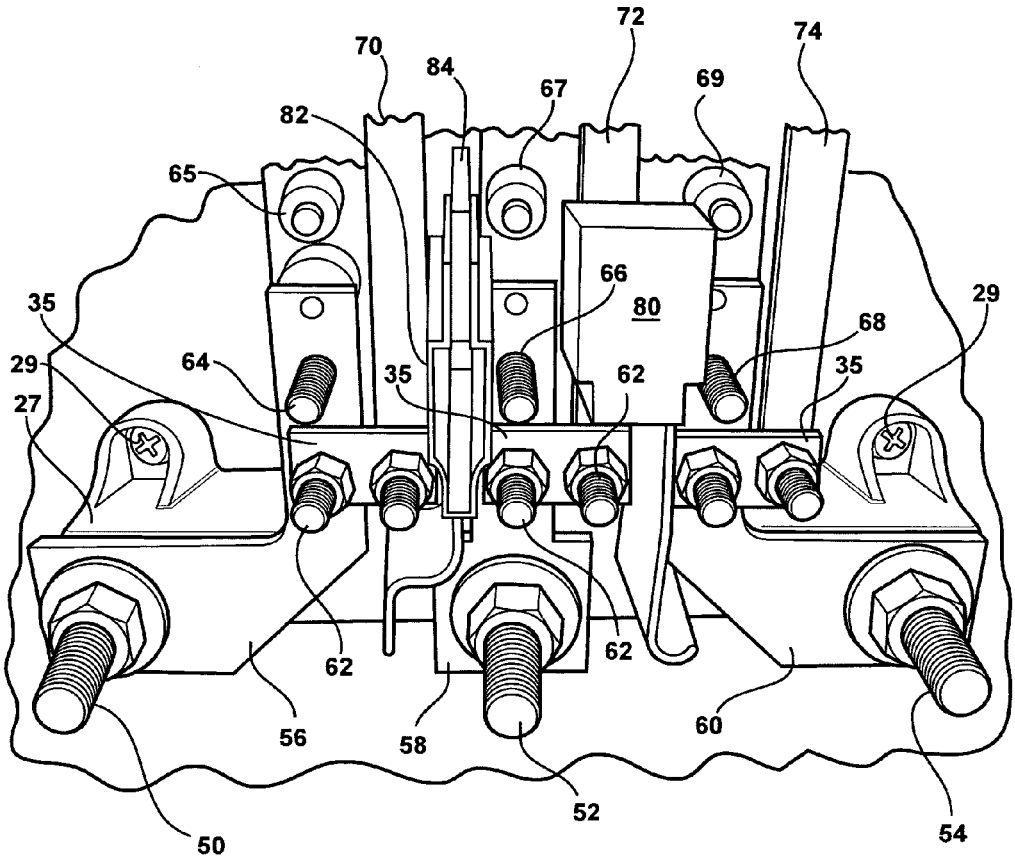
FIG - 3 PRIOR ART
FIG. 3 is a partial, enlarged perspective view of the load terminals in the prior socket shown in FIG. 1.

For clarity in understanding the features and advantages of the present watthour meter socket adapter, a description will be first presented with reference to FIGS. 1–5 of a prior art K-series watthour meter socket designed for receiving a K-series watthour meter.

As shown in FIGS. 1–5, a K-series meter fitting which is generally in the form of a closed housing or enclosure having a removable cover, as described hereafter, and a back wall or base plate 22. An upper insulating block 23, typically made of a plastic, is fixed by fasteners 25 to the back wall 22. Three line terminals 24, 26 and 28 for an exemplary three-phase power application are mounted on the upper block 23. It will be understood that only two terminals, such as terminals 24 and 26, are necessary for single phase applications. The terminals 24, 26 and 28 are mounted on the base plate 22 by a threaded connection, for example. The terminals 24, 26 and 28 provide a connection point or terminal for power distribution line conductors, not shown, which are mounted and secured in place over the terminals 24, 26 and 28.

Individual plate-like line bus bars 30, 32 and 34 are connected at one end to the terminals 24, 26 and 28, respectively, and are secured to the upper block 23 by fasteners 36. The bus bars 30, 32 and 34 each support a first fastener, such as bolts 40, 42 and 44, respectively. The bolts 40, 42 and 44 are arranged in a first row hereafter defined as a first meter mounting position in which the bolts 40, 42 and 44 are positioned for receiving the line bus bars of a watthour meter in a power measuring or metering position.

A second row of second fasteners, such as bolts 46, 48 and 50, are also mounted on and extend from the bus bars 30, 32 and 34, respectively. The fasteners or bolts 46, 48 and 50 are arranged in a second row hereafter referred to as an out of service meter position.

Similar load connections are also mounted on a lower insulating block 27 by fasteners 29 and include terminals 50, 52 and 54 which provide a terminal or connection point for distribution load conductors, not shown. Bus bars 56, 58 and 60 are also mounted on the lower block 27 and are connected at one end to the terminals 52 and 54 respectively. Each bus bar 56, 58 and 60 are secured by fasteners 62 to the lower block 27. Meter mounting fasteners, such as bolts 64, 66 and 58, are respectively carried on each bus bar 56, 58 and 60 and extend therefrom for receiving watthour meter load conductors or bus bars in a power metering position.

In a meter bypass mode of operation, jumper bars or straps 70, 72 and 74 extend between and have opposite ends located adjacent to the individual line bus bars 30, 32 and 34 and the load bus bars 56, 58 and 60 and fixed to the upper block 23 and the lower block 27 by fasteners 36, etc. The ends adjacent to the load bus bars 30, 32, and 34 are electrically coupled to the load bus bars 30, 32, and 34, respectively, by jumper straps 35.

Figure 4:
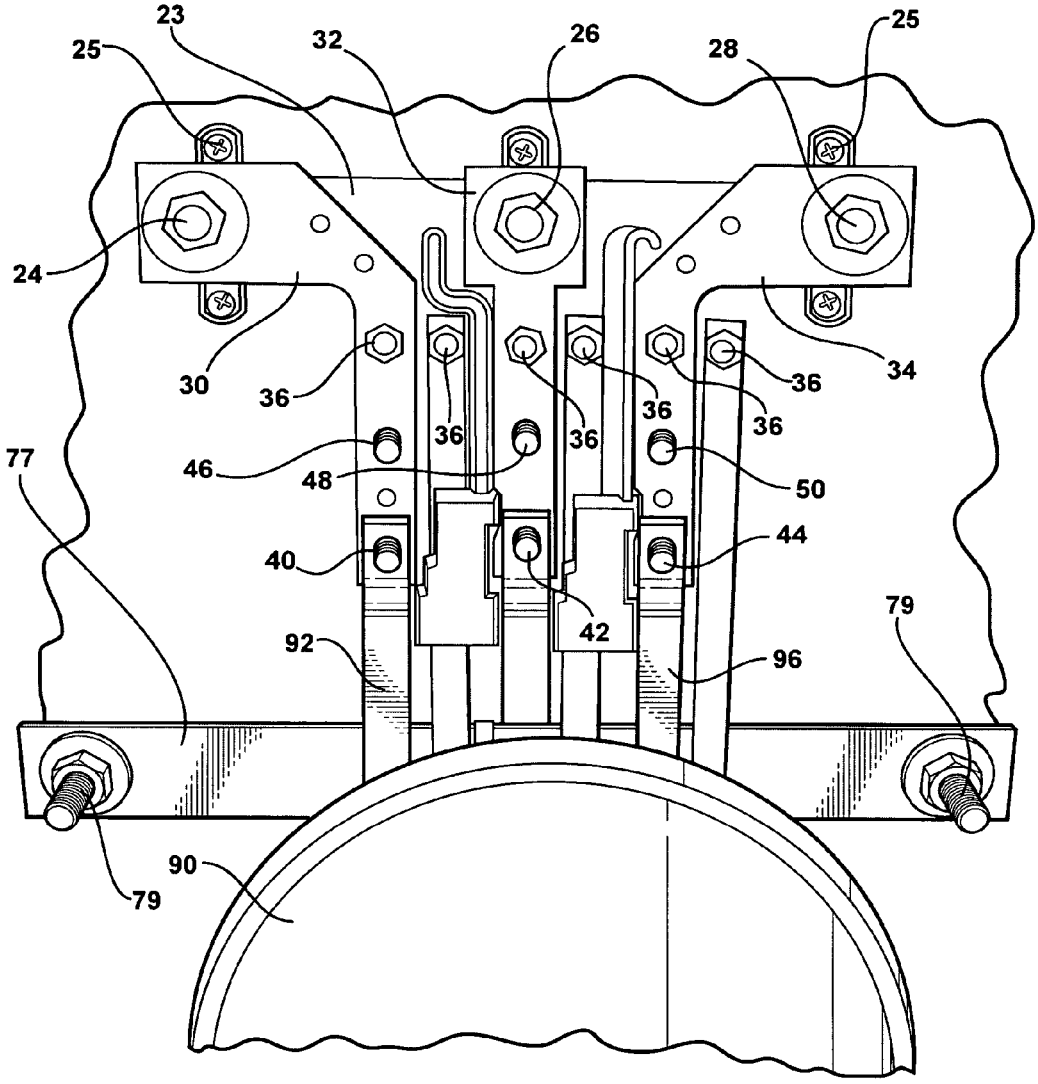
FIG - 4 PRIOR ART
FIG. 4 is a partial, enlarged perspective view showing the mounting of the line bus bars of a prior art watthour meter in the socket shown in FIG. 1.

As shown in FIGS. 1 and 4, for example, a neutral or ground strap 77 in the form of a metallic plate is fixed on the back wall 22 between the terminals 24, 26, 28 and the terminals 50, 52 and 54 by threaded studs 79.

Line insulator blocks 76 and 78 are mounted between adjacent line bus bars 30, 32 and 34 to provide sufficient electrical insulation between the high current carrying bus bars 30, 32 and 34. Similar load insulator blocks 80 and 81 are mounted between two of the load bus bars 58 and 60 and between load bus bars 56 and 58, respectively. A ground terminal insulator bracket or block 82 is clipped onto the block 81 as shown in FIG. 5 and provides insulation around one meter ground tab 83, which plugs into a ground terminal assembly 84 coupled to the neutral or ground strap 77.

As shown in FIG. 4, a K-series watthour meter 90 has, for the exemplary three-phase power application shown in FIGS. 1–5, three separate line conductors 92, 94 and 96, each in the form of a rigid bus bar having sufficient cross-section to carry up to 400 amps of current, for example. The bus bars 92, 94 and 96 extend outward generally parallel to the bottom wall of the meter 90, and then bend away from the bottom wall of the meter 90 before transitioning to an outwardly extending flange end generally parallel to the bottom wall of the meter 90. Apertures are formed in the end flanges for mounting over the line mounting fasteners 40, 42 and 44 or 46, 48 and 50 in the first and second rows of fasteners.

Figure 5:
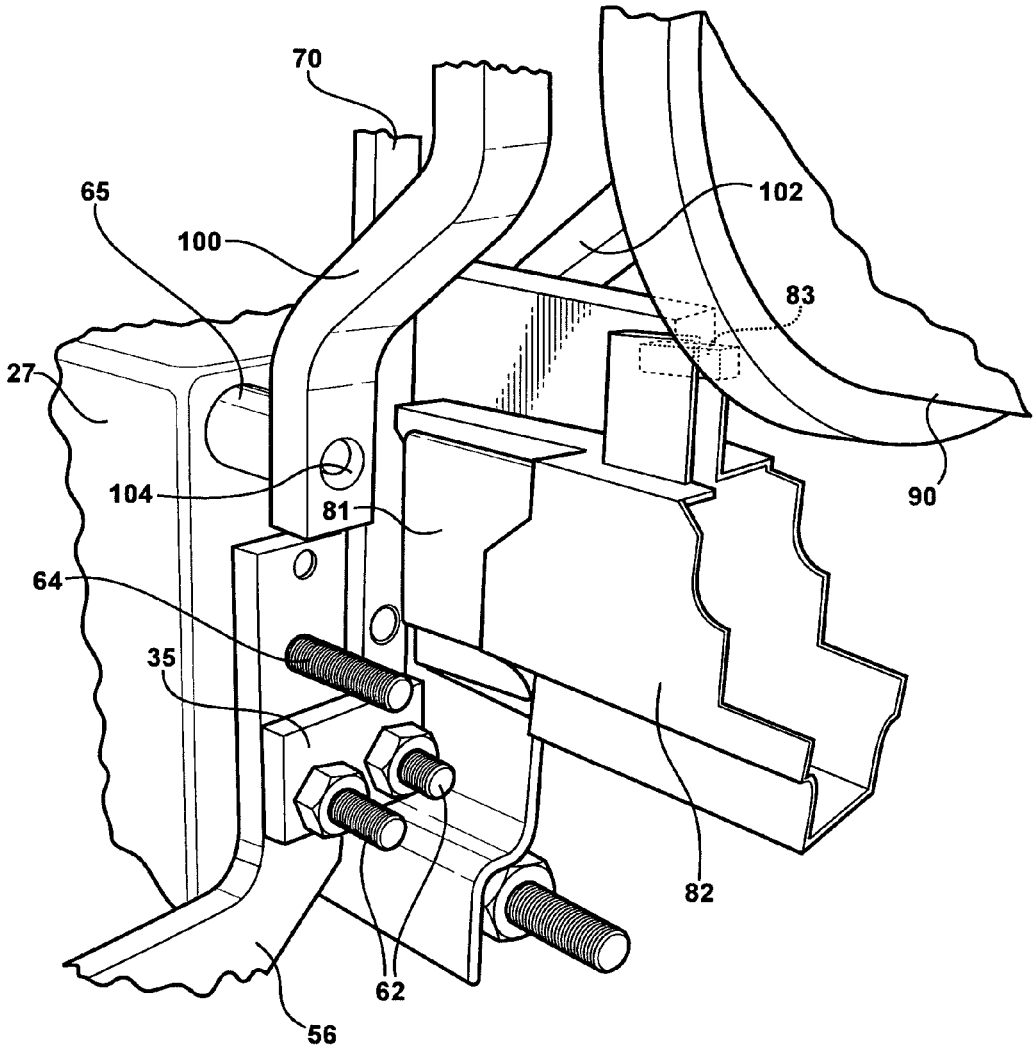
FIG - 5 PRIOR ART
FIG. 5 is a partial, perspective view showing the mounting of a prior art watthour meter in the prior art socket shown in FIG. 1.

As shown in FIG. 5, the watthour meter 90 has similarly constructed load bus bars, only two of which, namely bus bars 100 and 102, are shown. The load bus bars 100 and 102 also have a generally bent configuration and an aperture 104 for mounting over the mounting fasteners 64, 66 and 68 or one of the insulated posts 65, 67 and 69.

Referring now to FIGS. 6–16, there is depicted a watthour meter socket adapter 150 which can be mounted in a K-series meter fitting shown in FIG. 1 and is capable of receiving a plug-in, self contained watthour meter or a transformer rated watthour meter.

Figure 6:
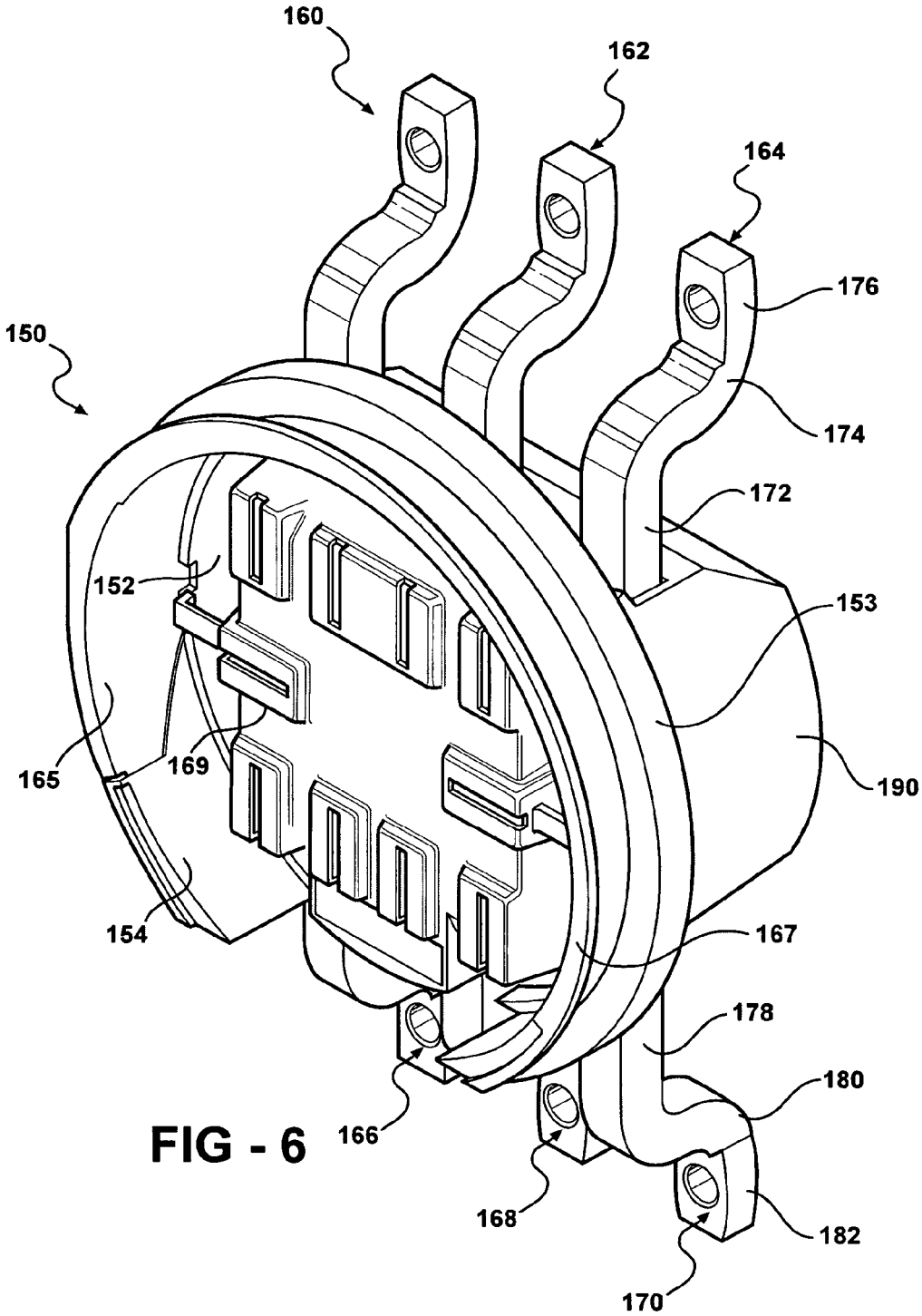
FIG. 6 is a partially broken away, front perspective view of one aspect of a watthour meter socket adapter.

As shown in FIG. 6, the watthour meter socket adapter 150 includes a bottom wall 152 and a sidewall 154 extending therefrom. The bottom wall 152 and the sidewall 154 may be of an integral, one piece, unitary or monolithic construction or the sidewall 154 may be coupled to a separate base, with a separate bottom wall affixed thereto, as described hereafter.

A mounting flange 153, generally in the same plane as the bottom wall 152, projects radially outward from the sidewall 154.

A plurality of individual jaws are mounted in the bottom wall 152, with the jaw contact portion of each jaw disposed within the interior of the sidewall 154. A strap or blade terminal 171 is connected to each jaw contact and projects through and outward from the bottom wall 152. Ground straps 165 and 167 as well as an insulating shield 169 are also optionally mounted in the socket adapter 150. Further details concerning the ground straps 165 and 167 and the shield 169 may be had by referring to U.S. Pat. Nos. 5,571,031, 6,325,66 and 6,478,589, all of which are assigned to the assignee of the present invention and all of which are incorporated herein in their entirety with respect to the ground straps and the shield.

Figure 10:
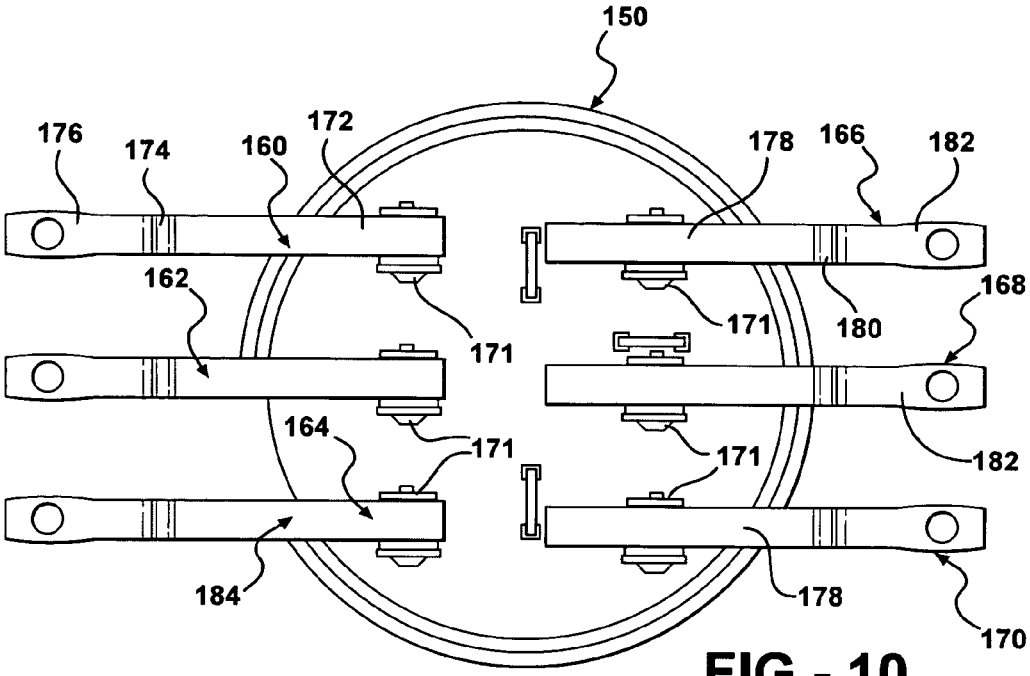
FIG. 10 is a rear elevational view of the socket adapter shown in FIG. 6, with the rear housing removed.

A plurality of line bus bars, with three bus bars 160, 162 and 164 illustrated in FIG. 10 for the exemplary three-phase application described by way of example only for the present invention, and three load bus bars 166, 168 and 170 are provided on the adapter 150. Each of the bus bars 160, 162, 164, 166, 168 and 170 is formed of an electrically conductive material, such as copper, copper alloy, etc. Each bus bar has a generally polygonal cross-section of sufficient area to provide the desired maximum current carrying capacity of the socket adapter 150.

Figure 11:
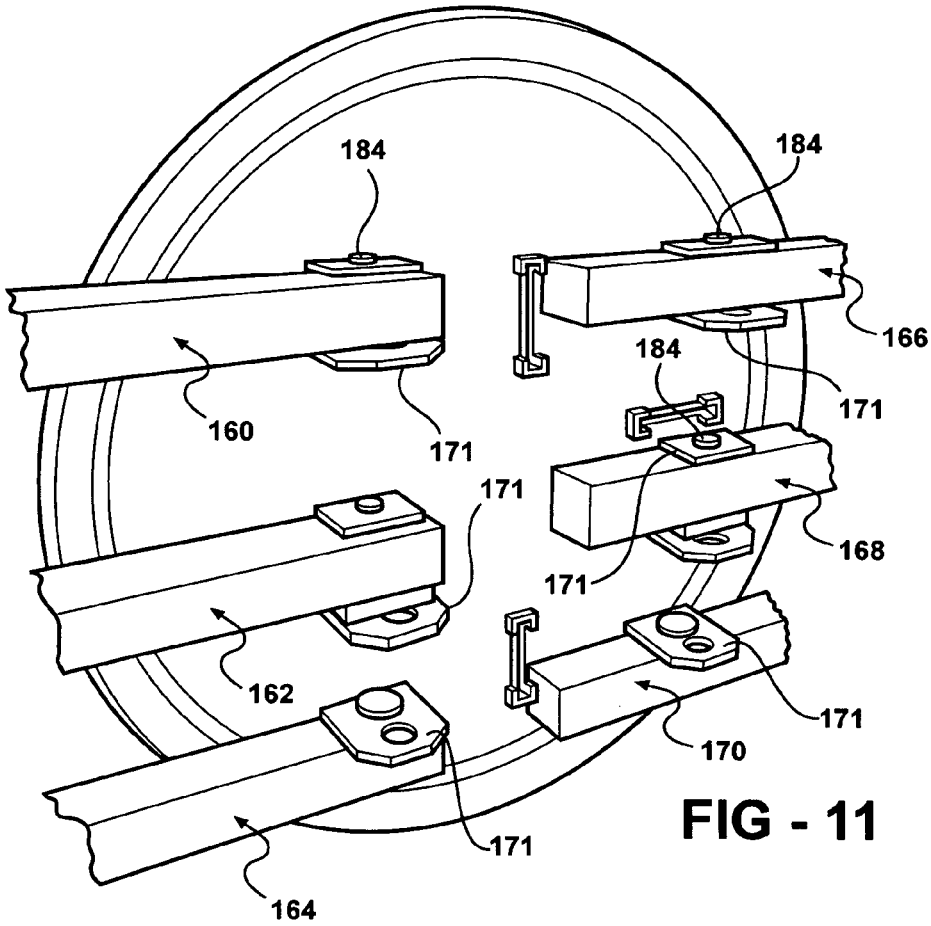
FIG. 11 is a rear perspective view of the socket adapter shown in FIG. 10, with the rear housing removed.

As shown in FIGS. 10 and 11, each line bus bar 160, 162 and 164 has a first generally linear planar portion 172, which transitions into an arcuate or angularly bent intermediate portion 174 which itself transitions into a generally linear or planar end portion 176 which is generally parallel to but offset from the linear portion 172. The load bus bars 166, 168 and 170 have a similar configuration with each load bus bar having a generally linear or planar first portion 178 which transitions into a bent or angularly disposed intermediate portion 180 which itself transitions into a generally planar or linear end portion 182 disposed generally parallel to but offset from the first linear portion 178.

Apertures are formed in the end portions 176 and 182 of each bus bar 160, 162, 164, 166, 168 and 170 for mounting over one of the mounting fasteners in the K-series meter fitting shown in FIG. 1, as described hereafter.

As shown in FIG. 10 one or more of the bus bars, such as bus bar 164, has an optionally mounted electrically insulating coating or sleeve 184 applied over a portion of the length thereof.

As shown in FIGS. 10 and 11, each bus bar 160, 162, 164, 166, 168 and 170 is coupled to one of the socket adapter blade terminals 171 by a fastener 184 which extends through the blade and the linear portion 172 or 178 of each bus bar.

Figure 7:
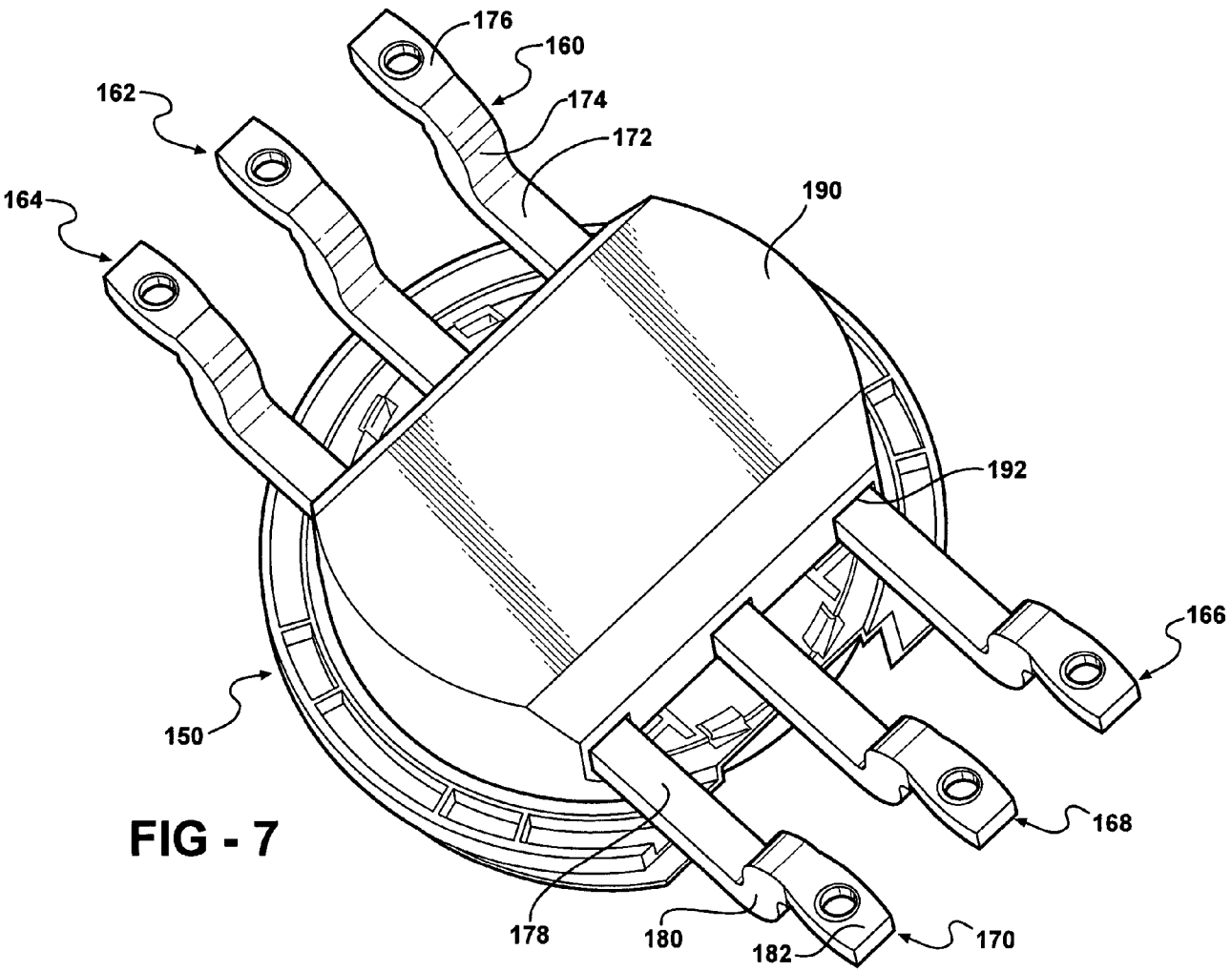
FIG. 7 is a rear perspective view of the socket adapter shown in FIG. 6.

An optional cover or housing 190, shown in FIGS. 6 and 7, is mounted over the ends of the linear portions 172 and 178 of each of the bus bars 160, 162, 164, 166, 168 and 170 and the connections of each bus bar to the socket adapter blade terminals. The housing 190, which can be formed of the same material as the socket adapter housing, can be affixed to the bottom wall 152 of the socket adapter 150 by suitable fastening means, such as adhesive, mechanical fasteners, including snap connectors, sonic or heat welding, etc.

Figure 12:
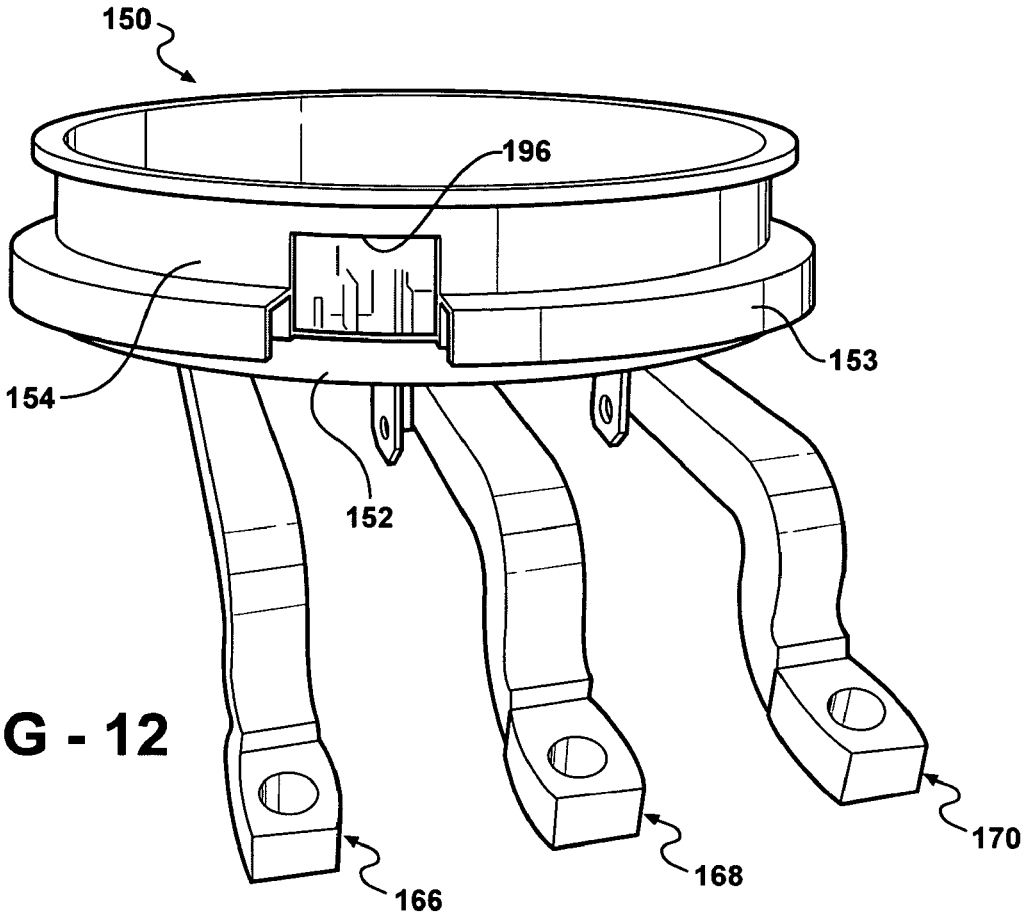
FIG. 12 is a front perspective view of the socket adapter shown in FIG. 6.

The housing 190 includes one or more apertures or slots 192 on opposite sides to allow the bus bars 160, 162, 164, 166, 168 and 170 to extend therethrough. As shown in FIG. 12, only a small window or cutout 196 need be made in the entire sidewall 154 of the housing of the socket adapter 150 to fit around the ground terminal and/or ground terminal mounting bracket in the socket.

Figure 8:
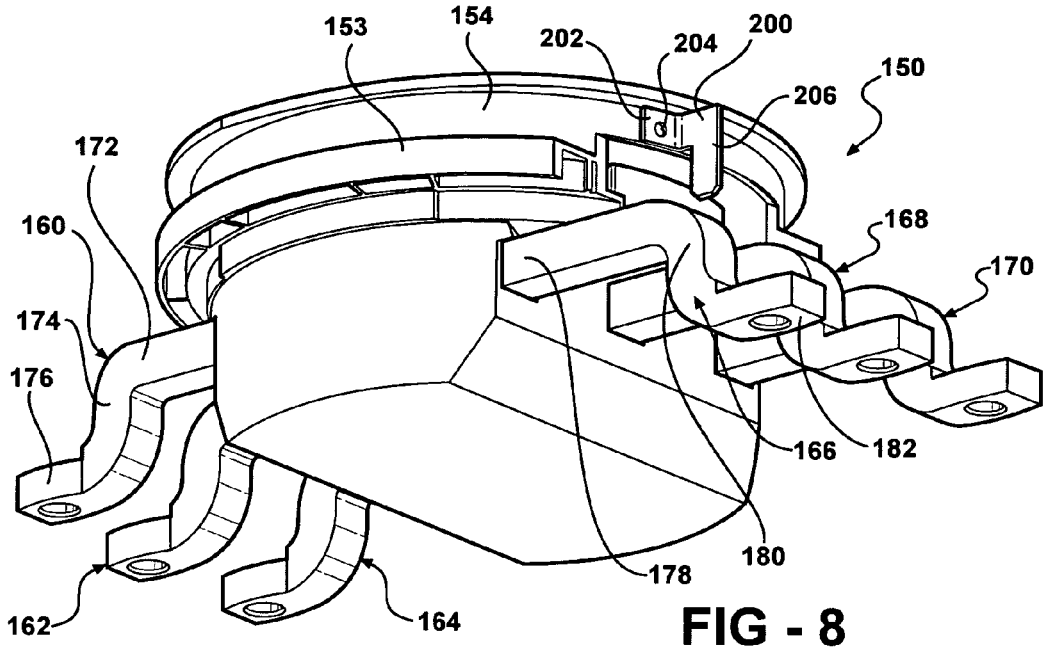
FIG. 8 is an enlarged, side perspective view of the socket adapter shown in FIGS. 6 and 7.
Figure 9:
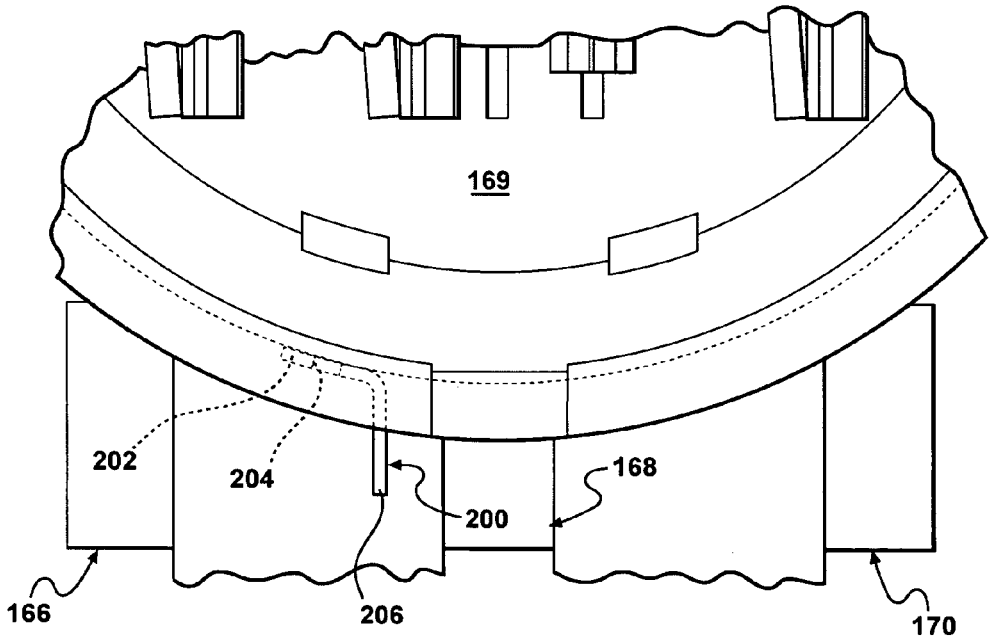
FIG. 9 is an enlarged, partial front elevational view of the socket adapter shown in FIGS. 6–8.

Another feature is shown in FIGS. 8 and 9. An electrically conductive tab 200 has a first portion or leg 202 which is mounted to the sidewall 154 of the adapter housing by means of a fastener extending through an aperture 204 in the leg 202. A terminal-like leg 206 extends angularly from the leg 202 radially outward from the sidewall 154 and is positioned for mounting in the socket ground terminal 84 in the K-series meter fitting shown in FIG. 1. A fastener, not shown, mountable through the aperture 204 in the ground terminal 200 projects through the interior of the sidewall 154 and provides a convenient attachment point for a push-on terminal, wire connector, etc., which can extend to the ground terminal or jaw in the socket adapter.

The linear portions 172 and 178 of the line bus bars 160, 162 and 164, and the load bus bars 166, 168 and 170 are designed with a specific length to enable the intermediate portions 174 and 180 and the end portions 176 and 180 of each bus bar to clear the line and load insulator blocks and the ground terminal bracket so as to be mountable over the load mounting fastener 64, 66 and 68 in the upper row of line fasteners 46, 48 and 50 which, as described above in conjunction with the prior art socket, as shown in FIGS. 1–5, were previously employed for the non-metering mounting position of the K-series watthour meter. However, since the mounting fasteners 46, 48 and 50 are mounted on the line bus bars 30, 32 and 34 as are the metering position mounting fasteners 40, 42 and 44, the socket adapter 150 remains connected to line power.

Figure 16A:
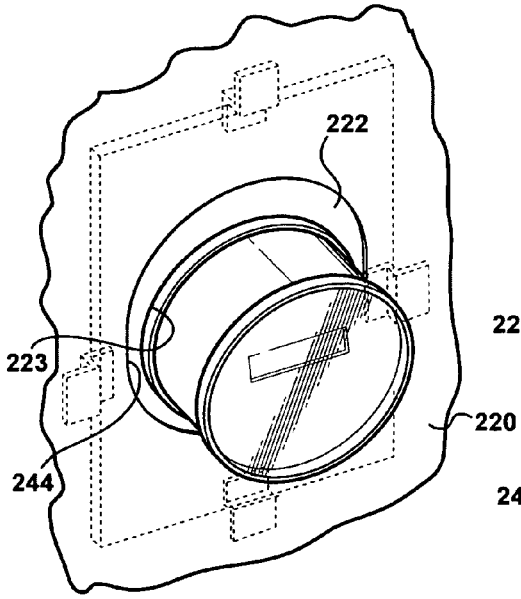
FIGS. 16A and 16B are partial, perspective views showing the visible portion of a meter mounted in the present socket adapter extending through the plate in the socket cover in two different mounting positions.
Figure 16B:
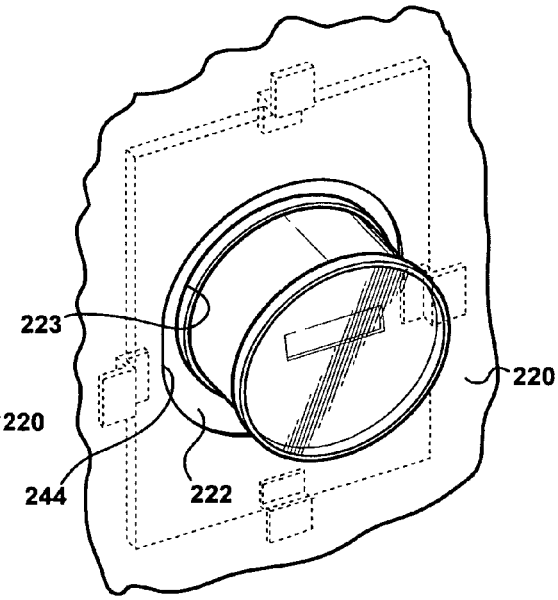
Figure 15:
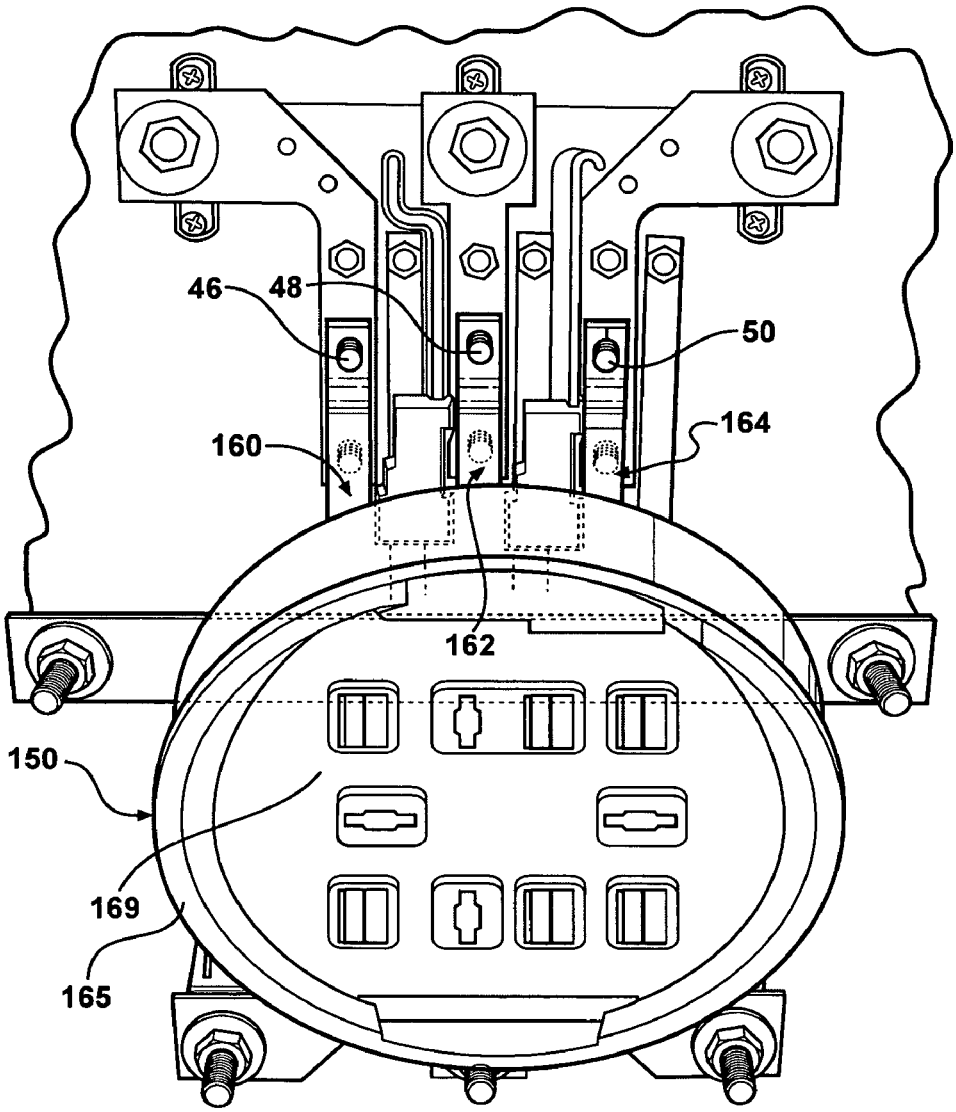
FIG. 15 is a front perspective view showing the mounting of the socket adapter conductors to the upper line connections in a socket.

As shown in FIGS. 16A and 16B, a socket cover 220 has an elongated, oblong-shaped aperture 224 which forms at least a portion of an aperture means carried on the cover 220 for allowing extension of a portion of a watthour meter mounted in the socket adapter 150 through the cover 220. FIG. 16A depicts the normal, in-service metering position of the watthour meter in the meter fitting shown in FIGS. 1–5 in a prior art K-series meter fitting shown in FIGS. 1–5. FIG. 16B depicts the same prior art watthour meter in an out-of-service, non-metering position and disconnected from all of either the line terminals or the load terminals in the prior art K-series meter fitting shown in FIGS. 1–5.

The aperture means also includes a panel or plate 222 which is repositionally mounted on the cover 220 and has a circular aperture 223. The aperture 223 in the panel 222 is longitudinally off center between the ends of the panel 222. This enables the panel 222 to be repositioned in one of two 180° offset or rotated positions relative to the cover 220 thereby moving the aperture 223 in the panel 222 vertically up and down in a normal mounting orientation of the meter fitting so as to enable a portion of the watthour meter mounted in the socket adapter 150 in the meter fitting housing to extend through the aperture 223 in the panel 220 and the aperture 224 in the cover 220 in either the prior art normal in-service position or the out-of-service position. The cover 220 and the panel 222, which are both used in the prior art K-series meter fitting, can be employed with the socket adapter 150. However, the upper position shown in FIG. 16B, which is normally used as the prior art out-of-service non-meter position, is now employed as the in-service, metering position of the socket adapter and the watthour meter.

Figure 13A:
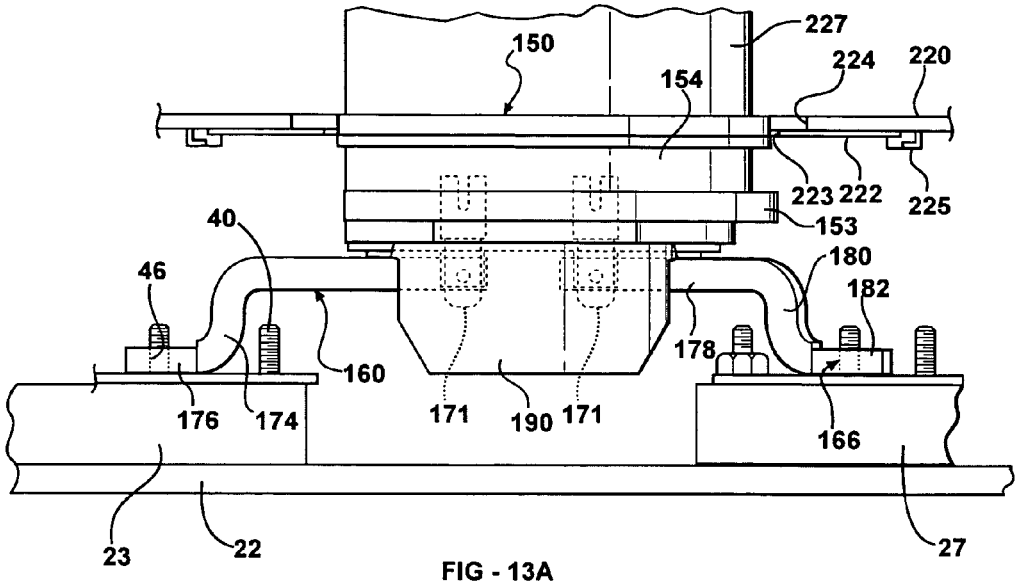
FIG. 13A is a side elevational view of the socket adapter.

In the socket adapter and meter position shown in FIGS. 13A and 16, the panel 222 is repositionally mounted on the cover 220 by means of clips 225 which are fixed to the inside surface of the cover 220. One of more of the clips 225 may be movable or separable from the cover 220 to allow the panel 222 to be reversed 180E to reposition the aperture 223 from the normally in service meter position which is closer to the bottom edge of the cover 220 in the normal mounting position of the socket, to the out-of-service metering position in which the aperture 223 in the panel 220 is located closer to the top edge of the panel 220 in normal mounting position of the panel 220 then when the aperture 223 is in the in-service metering position. In this second position shown in FIGS. 13A and 16B, the dome portion of a watthour meter 227 can project outwardly through the aperture 223 in the panel 222 and the elongated aperture 224 in the cover 220 after the watthour meter 227 is mounted in the socket adapter 150. However, since the socket adapter 150 has been moved into the normal out-of-service metering position, the side edge of the socket adapter 150 clears the ground terminal insulator block 82.

Figure 13B:
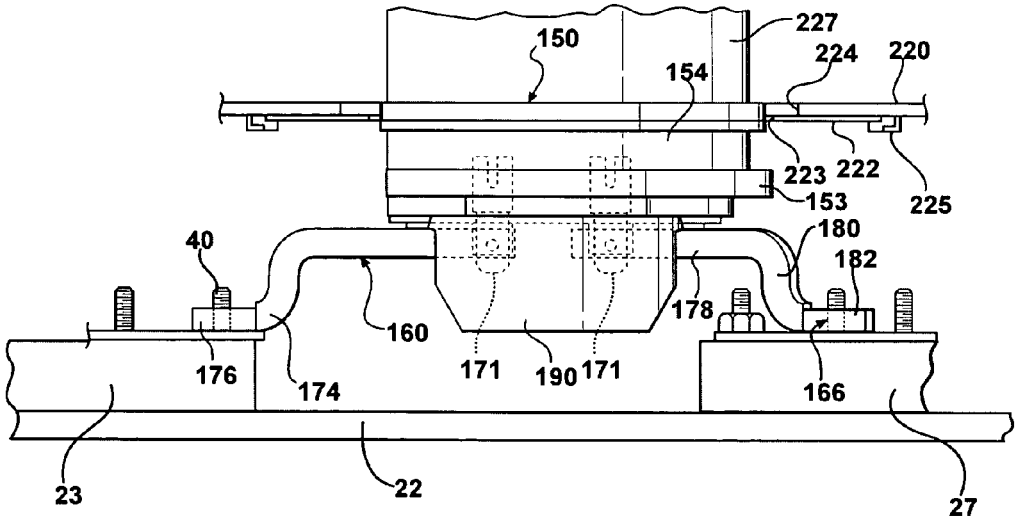
FIG. 13B is a side elevational view of another aspect of the socket adaptor.
Figure 14:
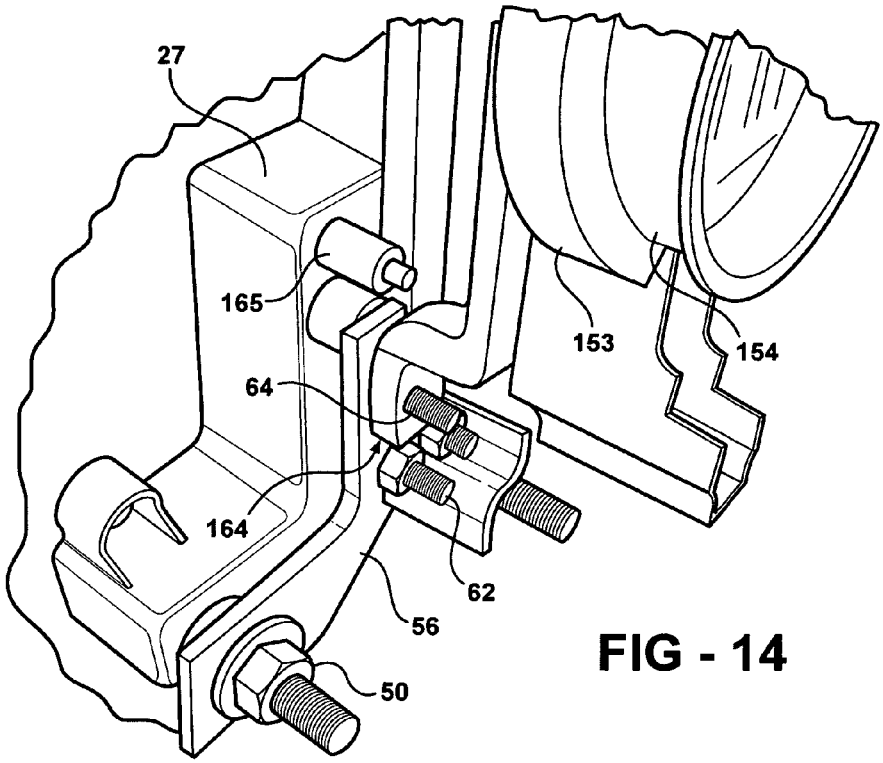
FIG. 14 is a partial, perspective view showing the mounting of the socket adapter to the lower load connections in a socket.

Referring now to FIG. 13B, another aspect of the socket adapter 150 is disclosed which still enables the socket adapter 150 and the watthour meter to be positioned in the upper prior out-of-service position of the aperture 223 in the cover panel 222, but in a metering connection to the meter fitting terminals. This is achieved by repositioning the socket adapter 150 on the bus bars 160, etc., so that the upper bus bars 160, etc., can be attached to the normal in-service studs 40, 42, and 44, but the socket adapter 150 is now in the prior art out-of-service position, while still being connected in a metering state to the meter fitting terminals.

In both aspects of the socket adapter 150 mounting position shown in FIGS. 13A and 13B, the shape and configuration of the load conductors 180, etc., space the housing of the socket adapter 150 from the ground terminal insulator block 82.

Referring now to FIG. 17, there is shown another aspect of a socket adapter 250 which is constructed substantially the same as the socket adapter 150. The socket adapter 250 includes a bottom wall 252 from which a side wall 254 extends. The bottom wall 252 and the side wall 254 may be of integral, one-piece, unitary, or monolithic construction, or the side wall 254 may be separately coupled to a separate bottom wall or base 252.

Single or polyphase jaw contacts 256, only one phase of which is shown in FIG. 17, are mounted on the bottom wall 252 of the socket adapter 250. The jaw contacts 254 are positioned and shaped for receiving the blade terminals of a watthour meter, not shown, in a snap-in connection.

A plurality of bus bars 260, only one of which is shown in FIG. 17, are formed of an electrically conductive material and have a generally polygonal cross-section of sufficient area to provide the desired maximum current carrying capacity of the socket adapter 250.

As with the bus bars 160, 162, 164, 166, 168, and 170, described above and shown in FIGS. 6 and 13, the bus bar 260 has a first linear portion 262 which extends integrally through the cover or housing 264 connected to the bottom wall 252. The bus bars 260 are configured for current transformer socket applications wherein a coil 266 is magnetically coupled about the linear portion 262 of the bus bar 260. Leads 268 and 270 extend from the coil 266 to terminal connections on the jaw contacts 256 and 258 of one phase in the socket adapter 250. A spring jaw 274, for example only, may be mounted within the cover or housing 264 for fixedly mounting the bus bar 260 in the housing 264.

As with the bus bars described in the prior aspect of the socket adapter 150, each bus bar 260 has arcuate or angularly bent intermediate portions 276 and 278 at opposite ends of the linear portion 262. Each of the intermediate portions 276 and 278 transitions into a generally linear or planar end portion 280 and 282, respectively. Apertures 284 are formed in each of the linear end portions 280 and 282 for mounting the end portions 280 and 282 over the mounting fasteners in the K-series meter fitting shown in FIG. 1 and as described above for the socket adapter 150. The lengthwise extent of the ends of the bus bars 260, etc., with respect to the cover 264, can be varied in the manner described above and shown in FIG. 13A so as to enable the line end of each bus bar 260, etc., to be connected to the normal prior art out-of-service studs, but in a metering connection. Alternately, the mounting position of the socket adapter 250 relative to the bus bars 260, etc., can be varied to enable the socket adapter 250 to be positioned closer to the line end of each bus bar 260, etc., and, also, to enable the ends of each line bus bar 260, etc., to be connected to the in-service metering terminals in the meter fitting as shown in FIG. 13B.

Figure 19:
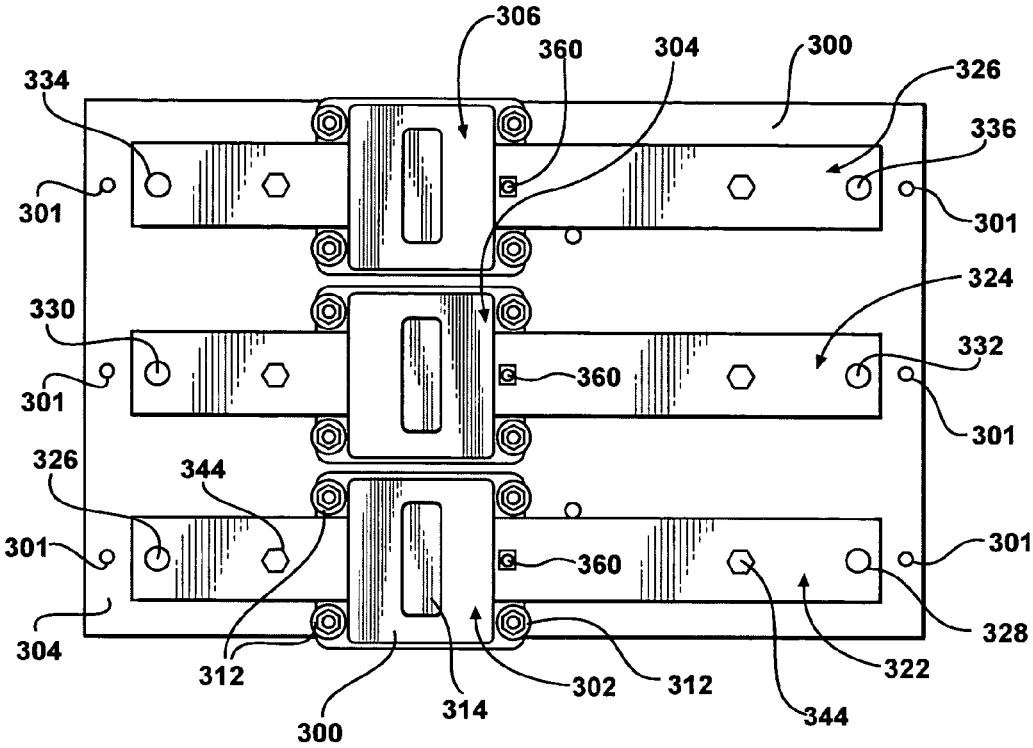
FIG. 19 is a plan view of the current transformer mounts shown in FIG. 18.
Figure 20:
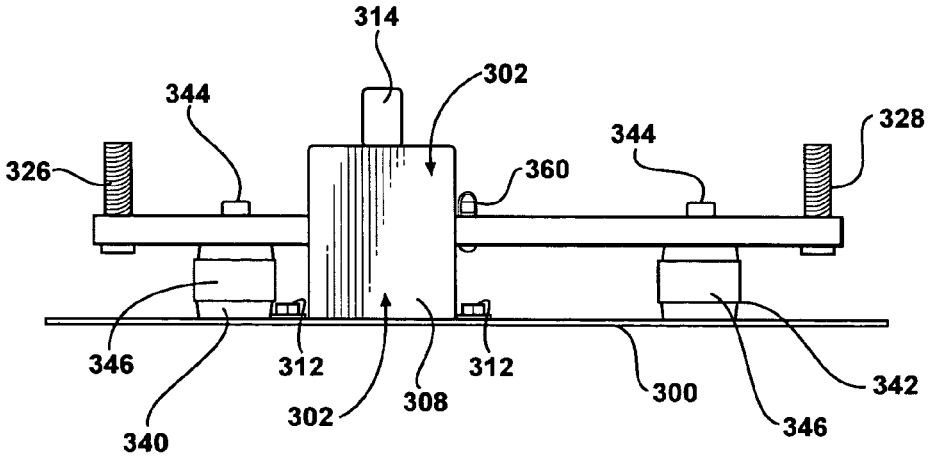
FIG. 20 is a side elevational view of FIG. 19.

Referring now to FIGS. 18–20 there is depicted another aspect in which current transformers are mounted in the K-series meter fitting shown in FIGS. 1–5.

In this aspect, a mounting plate 300 is mountable in the meter fitting after all of the components, including the bypass jumper 70, 72 and 74, the line bus bars 30, 32, and 34, the load bus bars 56, 58 and 60 as well as the insulating mounting blocks 23 and 27 and the neutral plate 77 are removed from the meter fitting. Apertures 301 in the mounting plate 300 are alignable with the apertures which originally received the insulating block fasteners 25 and 29. This enables the mounting plate 300 and the components described hereafter which are mounted on the plate 300 to be easily and quickly mounted on the back wall 22 of the meter fitting as a unitary assembly.

The mounting plate 300 supports a plurality of current transformers, with three current transformers 302, 304, and 306 being illustrated by way of example only for a three phase circuit. Only two current transformers are used for single phase power service.

The current transformers 302, 304, and 306 may be of any power size, with 600 amp current capacity current transformers being used by way of example. Each current transformer 302, 304, and 306 in a form of a toroidal wire coil 308 having a through bore 310 extended between opposed side surfaces. The coil 308 is mounted on the mounting or base plate 300 by means of fasteners 312.

By way of example only, removable caps 314 are mounted on each coil 308 to cover current terminals electrically connected to the ends of the coil 308.

Each current transformer 302, 304, and 306 is in the form of a window-style current transformer in that the through bore 310 allows an electrical conductor, typically in the form of a rigid, high current carrying capacity bus bar 322, 324, and 326 to be passed there through. Each bus bar 322, 324, and 326 has studs or bolts mounted at opposite ends for attachment to the line and load conductors in the socket. Thus, the bus bar 322 is provided with a line stud 326 and a load stud 328. The bus bar 324 has a line stud 330 and a load stud 332. The bus bar 326 has a line stud 334 and a load stud 336. Since the mounting plate 300 fits within the existing K-series socket footprint of the back wall 22 shown in FIG. 1, the line and load studs 326, 328, 330, 332, 334, and 336 are positioned in substantially the same location as the line and load stud terminals 24, 26, 28, and 50, 52, and 56 for the K-series meter fitting shown in FIG. 1. This allows easy reconnection of the connectors on the ends of the line and load conductors to the current transformer terminals or studs 326, 328, etc.

Each bus bar 322, 324, and 326 is fixedly mounted to the base or mounting plate 300 by at least one and, for example only, a pair of standoffs 340 and 342. Each standoff 340 and 342 includes a bolt 344 which extends through an aperture in each bus bar 322, 324, and 326 to secure the bus bar 322, 324, and 326 in a fixed position with respect to the mounting plate 300 and the associated current transformer 302, 304, or 306. An electrically insulating sleeve, such as a GLASTIC J standoff 346 is mounted about each bolt 344 for electrical insulation purposes.

As shown in FIGS. 18–20, a potential terminal 360 configured for receiving an external electrical conductor is mounted on each busbar 322, 324, and 326.

In use, when it is necessary to upgrade electrical service with higher current, the base plate 22, if present, or all of the associated meter fitting hardware shown in FIG. 1 is removed from the meter fitting. The mounting plate 300 carrying the current transformers 302, 304, and 306 for a three phase service is then mounted in the same footprint mounting location in the socket as the original K-series socket and fixed in place with fasteners via the mounting apertures 301 and the apertures in the back wall of the base plate 22 which previously received the mounting block fasteners 23 and 29. The connectors on the ends of the line and load power conductors in the meter fitting are then attached to the line and load studs 326, 328, 330, 332, 334, and 336 in the normal fashion.

Figure 21:
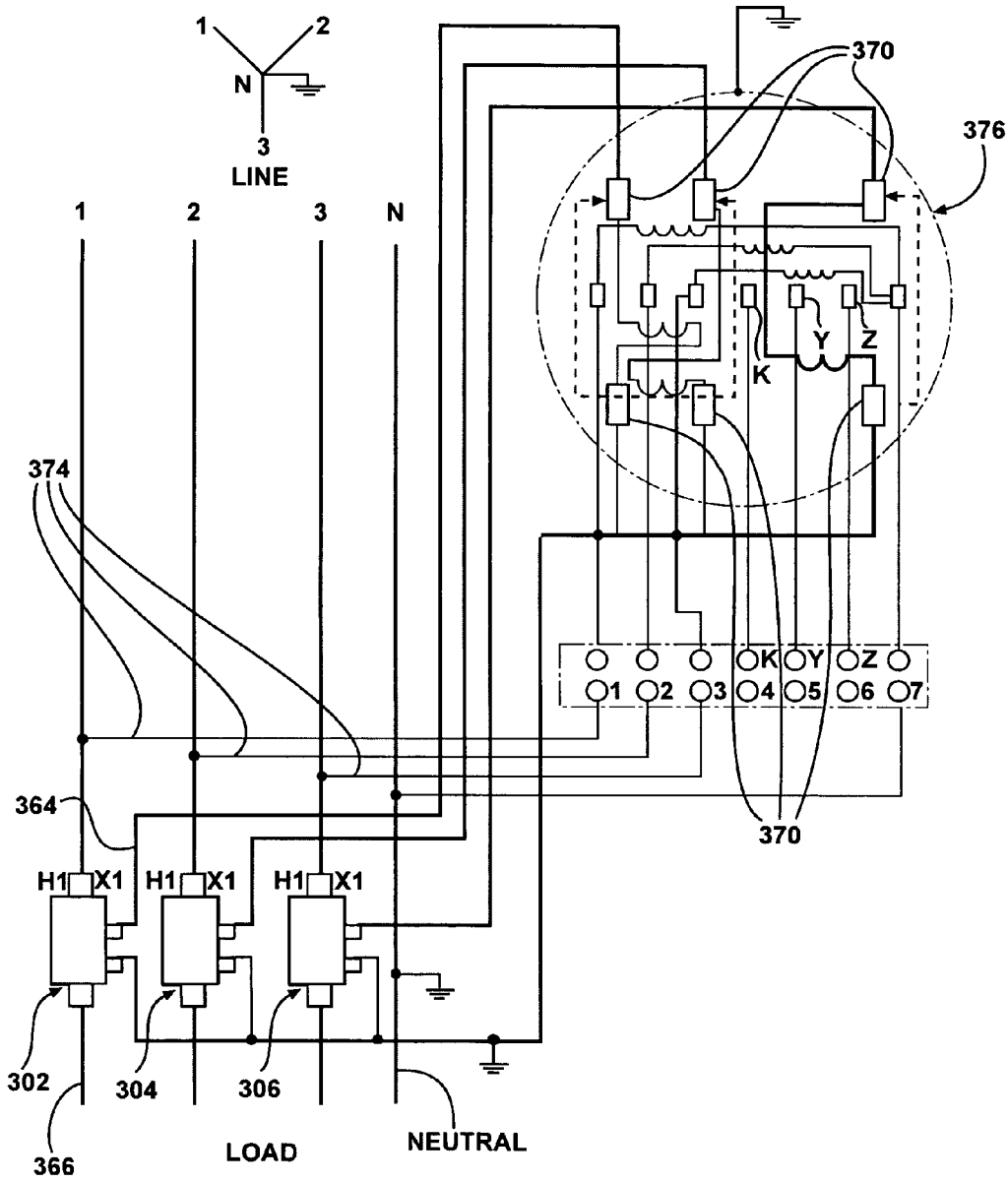
FIG. 21 is a schematic diagram showing the wiring of the current transformers of FIGS. 18–20 to an adjacent watt hour meter socket adapter.

As shown in FIG. 21, current leads, such as current leads 364 and 366 for the current transformer 302, are run from the current terminals on the coil 308 to selected jaws 370 in a watthour meter socket adapter 372 typically mounted in a separate enclosure adjacent to the K-series enclosure carrying the current transformers 302, 304, and 306. The same current connections are made for the other current transformers 304 and 306 to other jaw contacts 370 in the socket adapter 372. A snap-in watthour meter may then be employed in the watthour meter socket 372 for measuring power detected by the current transformers 302, 304, and 306.

As also shown in FIG. 21, potential leads, all denoted by reference number 374, may be connected to the potential terminals 360 on each of the bus bars 322, 324, and 326 and to potential terminals in the socket adapter 372.

Since the meter fitting no longer receives a watthour meter, a blank-out plate can be mounted on the cover 220 in place of the apertured plate 222.

What is claimed is:

1. An electrical power service apparatus comprising:

a meter fitting having an enclosure with line and load electrical power conductor connection terminals connected to line and load electrical connections adapted for connecting a watthour meter in an in-service metering position and electrical power conductor connection terminals adapted for connecting a watthour meter in an out-of-service, non-metering position with respect to the line and load power conductor connection terminals; and socket adapter means, for mounting a plug-in watthour meter in the normally out-of-service position with respect to the line and load power conductor connection terminals while electrically connecting the watthour meter to the line and load electrical connections and the line and load electrical power conductor connection terminals in an in-service metering connection.

2. The apparatus of claim 1 further comprising:

a cover mounted on the meter fitting enclosure and having an aperture for extension of at least a portion of the watthour meter mounted in the socket adapter means through the cover when the watthour meter is in either of the normally in-service position and the out-of-service position in the enclosure.

3. An electrical power service apparatus comprising:

a meter fitting having an enclosure with line and load electrical power conductor connection terminals connected to line and load electrical connections adapted for connecting a watthour meter in one of an in-service metering position and an out-of-service, non-metering position with respect to the line and load power conductor connection terminals;

socket adapter means, for mounting a plug-in watthour meter in the normally out-of-service position with respect to the line and load power conductor connection terminals while electrically connecting the watthour meter to the line and load electrical connections and the line and load electrical power conductor connection terminals in an in-service metering connection, the socket adapter means including:

a housing;

jaw contacts mounted in the housing for receiving blade terminals of a watthour meter in a plug-in connection; and line and load bus bar means, carried by the housing, for electrically connecting the jaw contacts to the line and load electrical connections in the meter fitting enclosure.

4. The apparatus of claim 3 wherein the line and load bus bar means comprises:

discrete line and load conductors carried by the housing for connecting discrete line and load jaws in the housing to the line and load electrical connections.

5. The apparatus of claim 3 wherein the line and load bus bar means comprises:

continuous conductors carried by the housing and having line and load electrical connection ends.

6. An electrical power service apparatus comprising:

a meter fitting having an enclosure with line and load electrical power conductor connection terminals connected to line and load electrical connections adapted for connecting a watthour meter in one of an in-service metering position and an out-of-service, non-metering position with respect to the line and load power conductor connection terminals;

socket adapter means, for mounting a plug-in watthour meter in the normally out-of-service position with respect to the line and load power conductor connection terminals while electrically connecting the watthour meter to the line and load electrical connections and the line and load electrical power conductor connection terminals in an in-service metering connection;

ground terminal means, mounted in the enclosure, for receiving a ground connection on the socket adapter means when the socket adapter means is mounted in the enclosure;

a ground terminal insulator mounted over at least a portion of the ground terminal means; and the socket adapter means spaced from the ground terminal insulator when mounted in the enclosure.

7. An electric power service apparatus comprising:

an enclosure;

line and load terminals in the enclosure for receiving electric power line and load conductors;

a line bus bar connected to each line terminal;

first normally out-of-service upper line connections and second, normally in-service lower line connections carried on each line bus bar;

a load bus bar connected to each load terminal;

a load electrical connection connected to each load bus bar;

a socket adapter carrying jaw contacts for removably receiving blade terminals of a watthour meter;

conductors carried by the socket adapter and coupled to the jaw contacts, the conductors having connection ends for connection to the line and load connections in the enclosure;

a cover mounted on the enclosure; and aperture means, carried on the cover, for allowing extension of a portion of a watthour meter mounted in the socket adapter through the cover, when the watthour meter is in a second normally out-of-service position.

8. The apparatus of claim 7 wherein:

the socket adapter conductors are rigid bus bars.

9. The apparatus of claim 7 further comprising:

a ground terminal mounted on the socket adapter;

an electrical conductor extending interiorly of the socket adapter between the ground terminal and a socket adapter ground terminal mounted in the socket adapter.

10. The apparatus of claim 7 wherein the socket adapter further comprises:

jaw contacts for one of single-phase, network, and polyphase power service.

11. The apparatus of claim 7 wherein the socket adapter further comprises:

the socket adapter includes jaw contacts for three phase power service.

12. The apparatus of claim 7 further comprising:

the conductors having an overall length to connect to the load connection on each load bus bar and the first normally out-of-service upper line connections on the line bus bars creating an in-service metering position of the socket adapter in the enclosure.

13. The apparatus of claim 7 wherein each of the socket adapter conductors comprises:

a first end portion connected to a jaw contact of the socket adapter, the first end portion defining a first plane;

a second end portion defining a second plane spaced from the first plane; and an intermediate portion coupling the first and second end portions.

14. The apparatus of claim 13 wherein the transition portion of each conductor comprises:

a monolithic bent portion extending between the first and second end portions.

15. The apparatus of claim 7 wherein the aperture means comprises:

a panel having a second aperture, the panel repositionable relative to the cover to position the second aperture to accept a portion of a watthour meter therethrough in a first normally in-service metering position in the enclosure and a second normally out-of-service position, the second aperture in the panel communicating with a first aperture in the cover.

16. The apparatus of claim 15 wherein the plate is positioned relative to the cover to position the second aperture in the plate in the second normally out-of-service metering position when the socket adapter is disposed in a metering state in the first normally out-of-service metering position.

17. The apparatus of claim 15 wherein:

the conductors having an overall length to connect the load connection on each load bus bar to the second normally in-service lower line connections creating an in-service metering position of the socket adapter in the enclosure, the socket adapter and the second aperture in the plate positioned in the first normally out-of-service metering position.

18. A socket adapter for mounting in an electrical power service enclosure having power terminals for receiving line and load power conductors and first and second upper line connections and at least one lower load connection connected to the terminal, the socket adapter comprising:

a housing carrying jaw contacts for receiving a plug-in watthour meter in a plug-in connection, a terminal coupled to each jaw contact and projecting from the housing; and electrical conductors coupled to the terminals and extending from the housing to a connection end mountable on one of the mounting connections in the enclosure, the conductors having a length to mount the housing to the load connection and the first upper line connection to connect the socket adapter in a metering state in a normally out-of-service, non-metering position in the housing.

19. A socket adapter for mounting in an electrical power service enclosure having power terminals for receiving line and load power conductors and first and second upper line connections and at least one lower load connection connected to the terminal, the socket adapter comprising:

a housing carrying jaw contacts for receiving a plug-in watthour meter in a plug-in connection, a terminal coupled to each jaw contact and protecting from the housing; and electrical conductors coupled to the terminals and extending from the housing to a connection end mountable on one of the mounting connections in the socket, the conductors having a length to mount the housing to the load connection and the first upper line connection defining an in-service metering position of the socket adapter, each of the rigid, electrical conductors including:

a first end portion connected to a terminal blade of the socket adapter, the first end portion defining a first plane;

a second end portion defining a second plane spaced from the first plane; and an intermediate portion coupling the first and second end portions.

20. The socket adapter of claim 19 wherein the transition portion of each rigid, electrical conductor comprises:

a monolithic bent portion extending between the first and second end portions.

21. A socket adapter for mounting in an electrical power service enclosure having power terminals for receiving line and load power conductors and first and second upper line connections and at least one lower load connection connected to the terminal, the socket adapter comprising:

a housing carrying jaw contacts for receiving a plug-in watthour meter in a plug-in connection, a terminal coupled to each jaw contact and projecting from the housing;

electrical conductors coupled to the terminals and extending from the housing to a connection end mountable on one of the mounting connections in the socket, the conductors having a length to mount the housing to the load connection and the first upper line connection defining an in-service metering position of the socket adapter:

a ground terminal mounted in the enclosure; and an electrical conductor extending interiorly of the housing between the ground terminal and a socket adapter ground terminal mounted in the housing.

22. A socket adapter for mounting in an electrical power service enclosure having power terminals for receiving line and load power conductors and first and second upper line connections and at least one lower load connection connected to the terminal, the socket adapter comprising:

a housing carrying jaw contacts for receiving a plug-in watthour meter in a plug-in connection, a terminal coupled to each jaw contact and projecting from the housing, the jaw contacts for one of single-phase, network, and polyphase power service; and electrical conductors coupled to the terminals and extending from the housing to a connection end mountable on one of the mounting connections in the socket, the conductors having a length to mount the housing to the load connection and the first upper line connection defining an in-service metering position of the socket adapter.

23. A socket adapter for mounting in an electrical power service enclosure having power terminals for receiving line and load power conductors and first and second upper line connections and at least one lower load connection connected to the terminal, the socket adapter comprising:

a housing carrying jaw contacts for three phase power service for receiving a plug-in watthour meter in a plug-in connection, a terminal coupled to each jaw contact and projecting from the housing;

electrical conductors coupled to the terminals and extending from the housing to a connection end mountable on one of the mounting connections in the socket, the conductors having a length to mount the housing to the load connection and the first upper line connection defining an in-service metering position of the socket adapter; and for three phase power service.

24. An electric power service apparatus comprising:

an enclosure;

line and load terminals in the enclosure for receiving electric power line and load conductors;

a line bus bar connected to each line terminal;

first normally out-of-service upper line connections and second, normally in-service lower line connections carried on each line bus bar;

a load bus bar connected to each load terminal;

a load connection connected to each load bus bar;

a socket adapter carrying jaw contacts for removably receiving blade terminals of a watthour meter;

conductors electrically coupled to the jaw contacts on the socket adapter and having line connections and load connections;

a ground terminal mounted in the enclosure and connected to a ground terminal in a with hour meter through the socket adapter;

a ground terminal insulating means, mounted over the ground terminal in the enclosure, for electrically insulating the ground terminal from adjacent load service connections;

a cover having an aperture defining first and second spaced positions of a watthour meter mounted in the socket adapter and extending through the aperture in the cover; and the socket adapter and the conductors positioning the socket adapter in a spaced position from the ground terminal insulating means such that a watthour meter mounted in the socket adapter extends through the second position of a watthour meter through the aperture in the cover.

25. An electrical power service apparatus comprising:

an enclosure;

line and load power terminals disposed in the enclosure;

a watthour meter socket adapter having jaw contacts for receiving blade terminals of a watthour meter;

a cover mounted on the enclosure, the cover including a first aperture accommodating a watthour meter mounted in the enclosure in contact with the line and load terminals in a first normally in-service metering position and a second normally out-of-service metering position, the second normally out-of-service position disposed above the first normally in-service mounting position when the enclosure is in a normal metering position;

means, mounted on the cover and carrying a second aperture, for extension of a watthour meter through the second aperture and the first aperture in the cover in either one of the first and second positions of the watthour meter relative to the first aperture in the cover; and electrical conductor means, connected to the jaw contacts, for coupling a watthour meter to line and load power terminals in the enclosure in a metering position where the watthour meter socket adapter is positioned in the second normally out-of-service position white creating an in-service metering position of the socket adapter, the watthour meter positioned to allow a watthour meter mounted in the socket adapter to extend through the second aperture in the plate in the second normally out-of-service metering position.

26. In an electrical power service apparatus including a meter fitting having an enclosure with line and toad electrical power conductor connection terminals and line and load electrical connections for connecting a watthour meter in in-service metering position and electrical power conductor connection terminals adapted for connecting a watthour meter in an out-of-service, non-metering position with respect to the line and load power conductor connection terminals, the improvement comprising:

socket adapter means for mounting a plug-in watthour meter in the normally out-of-service position with respect to the line and load power conductor connection terminals while electrically connecting the watthour meter to the line and load electrical connections in an in-service metering connection.

27. A method of mounting a watthour meter in an electrical service power apparatus including a meter fining have an enclosure with line and load electrical power conductor connection terminals and line and load electrical connections for connecting a watthour meter in one of an in-service metering position and an out-of-service, non-metering position with respect to the line and load power conductor connection terminals, the method comprising the steps of:

positioning a socket adapter, having jaw contacts adapted for receiving blade terminals of the plug-in watthour meter, in the meter fining enclosure so that a watthour meter mounted in the socket adapter is positioned in the normal out-of-service position; and connecting conductors on the socket adapter to the line and load electrical connections to connect the watthour meter in a metering state to the line and load electrical power conductor connection terminals when the watthour meter is in the normal out-of-service position.

28. The method of claim 27 further comprising:

mounting a cover on the meter fitting enclosure; and forming an aperture in the cover for receiving a portion of the watthour meter therethrough in both the normal in-service position and the out-of-service position of the watthour meter.

29. A method of mounting a watthour meter in an electrical service power apparatus including a meter fitting having an enclosure with line and load electrical power conductor connection terminals and line and load electrical connections for connecting a watthour meter to the line and load electrical power conductor connection terminals, the method comprising the steps of:

constructing a watthour meter socket adapter having jaw contacts for receiving blade terminals of a plug-in watthour meter and attaching the jaw contacts to electrical conductors extending from the socket adapter for connection to the line and load electrical connections in the meter fining enclosure to electrically couple the watthour meter to the line and load electrical power conductor connection terminals; and positioning the socket adapter and the conductors extending from the socket adapter in the meter fitting enclosure such that the socket adapter is mounted in the enclosure in a substantially non-interfering position with respect to a ground terminal insulating block mounted over a ground terminal in the meter fitting enclosure.

30. A method of mounting a watthour meter in an electrical service power apparatus including a meter fitting having an enclosure with line and load electrical power conductor connection terminals and line and load electrical connections for connecting a watthour meter in one of an in-service metering position and an out-of-service, non-metering position with respect to the line and load electrical power conductor connection terminals, the method comprising the steps of:

coupling conductors between one line electrical connection and one load electrical connection;

providing a socket adapter with a housing, and jaw contacts mounted in the housing adapted to receive a plug-in watthour meter;

extending a portion of the conductors through the socket adapter housing;

mounting current transformers in the socket adapter housing;

electrically connecting electrical conductors to the socket adapter jaw contact outputs of the current transformers;

fixedly mounting the electrical conductors in the socket adapter housing; and mounting the socket adapter housing in one of the in-service metering position and the out-of-service non-metering position while electrically connected in a metering state with the line and load power conductor connection terminals.

31. The method of claim 30 further comprising the step of:

mounting the socket adapter in an in-service position with respect to the line and load power conductor connection terminals.

32. The method of claim 30 further comprising the step of:

mounting the socket adapter housing in the meter fitting enclosure in an out-of-service position, while electrically connecting the conductors fixed to the socket adapter housing to the line and load power conductor connection terminals in an in-service metering state.

33. The method of claim 30 further comprising:

coupling a cover to the housing, the conductors extending through the cover.

34. An electrical service power apparatus including a meter fitting having an enclosure with line and load electrical power conductor connection terminals and line and load electrical connections for connecting a watthour meter in one of an in-service metering position and an out-of-service, non-metering position with respect to the line and load electrical power conductor connection terminals, comprising:

electrical conductors adapted to be coupled between one line electrical connection and one load electrical connection;

a socket adapter including a housing, jaw contacts mounted in the housing adapted to receive a watthour meter;

current transformers carried on the socket adapter housing, and electrically connected to the socket adapter jaw contacts and the electrical conductors; and the socket adapter housing mounted in one of the in-service metering position and the out-of-service non-metering position while electrically connected in a metering state with the line and load power conductor connection terminals.

35. The apparatus of claim 34 further comprising:

the socket adapter mounted in an in-service position with respect to the line and load power conductor connection terminals.

36. The apparatus of claim 34 further comprising:

the socket adapter housing mounted in the meter fitting enclosure in an out-of-service position, while electrically connecting the conductors fixed to the socket adapter housing to the line and load power conductor connection terminals in an in-service metering state.

37. The method of claim 34 further comprising:

a cover coupled to the housing, the electrical conductors extending through the cover.

* * * * *